US010738551B1

(12) United States Patent
Smith et al.

(10) Patent No.: US 10,738,551 B1
(45) Date of Patent: Aug. 11, 2020

(54) REAL TIME FLOW ANALYSIS METHODS AND CONTINUOUS MASS BALANCE AND WELLBORE PRESSURE CALCULATIONS FROM REAL-TIME DENSITY AND FLOW MEASUREMENTS

(71) Applicant: WellWorc, Inc., Houston, TX (US)

(72) Inventors: Bruce E. Smith, Wenatchee, WA (US); David P. Smith, Anchorage, AK (US); Michael B. Smith, Houston, TX (US); Scott A. Grubb, Fulshear, TX (US)

(73) Assignee: WellWorc, Inc, Houston, TX (US)

( * ) Notice: Subject to any disclaimer, the term of this patent is extended or adjusted under 35 U.S.C. 154(b) by 153 days.

(21) Appl. No.: 15/923,290

(22) Filed: Mar. 16, 2018

Related U.S. Application Data

(63) Continuation-in-part of application No. 15/588,631, filed on May 6, 2017.

(60) Provisional application No. 62/643,881, filed on Mar. 16, 2018, provisional application No. 62/580,271, filed on Nov. 1, 2017, provisional application No. 62/472,351, filed on Mar. 16, 2017, provisional application No. 62/332,809, filed on May 6, 2016.

(51) Int. Cl.
*E21B 21/08* (2006.01)
*E21B 47/06* (2012.01)

(52) U.S. Cl.
CPC ..... *E21B 21/08* (2013.01); *E21B 47/06* (2013.01); *E21B 47/065* (2013.01)

(58) Field of Classification Search
CPC ..... E21B 21/08
USPC ..... 175/38
See application file for complete search history.

(56) References Cited

U.S. PATENT DOCUMENTS

| | | | | |
|---|---|---|---|---|
| 7,908,034 | B2 * | 3/2011 | Gray | E21B 21/00 175/24 |
| 7,950,451 | B2 * | 5/2011 | Alberty | E21B 47/10 166/177.2 |
| 8,256,532 | B2 * | 9/2012 | Gray | E21B 21/08 175/38 |
| 8,528,660 | B2 * | 9/2013 | Santos | E21B 21/08 175/25 |
| 10,060,208 | B2 * | 8/2018 | Gumus | E21B 21/08 |
| 2002/0101373 | A1 * | 8/2002 | Arndt | G01F 23/284 342/124 |
| 2002/0112888 | A1 * | 8/2002 | Leuchtenberg | E21B 21/08 175/48 |
| 2013/0032401 | A1 * | 2/2013 | Edbury | E21B 7/06 175/24 |

(Continued)

*Primary Examiner* — Kenneth L Thompson
(74) *Attorney, Agent, or Firm* — Gable Gotwals

(57) ABSTRACT

Embodiments of a system and method of this disclosure continually determine a mass balance of a drilling or circulating system, using mass flow and density data adjusted for temperature and pressure. The system and method may be used to continually monitor and control wellbore pressures to achieve over-balanced managed pressure drilling ("MPD"). In some embodiments, the system and method may be used as a fluid tracking engine. In other embodiments, the system and method may be used to accurately track a fluid caliper intended to survey the well to determine string volumes or borehole volumes; an example is determining the volume of cement needed to circulate the cement or bring the cement up to desired height. The system and method may be used to track the effects of mixing. The system and method may also be used as a viscometer.

37 Claims, 27 Drawing Sheets

(56) References Cited

U.S. PATENT DOCUMENTS

| | | | | |
|---|---|---|---|---|
| 2016/0146653 | A1* | 5/2016 | Skelding | G01F 15/02 73/861.01 |
| 2017/0044857 | A1* | 2/2017 | Leuchtenberg | E21B 33/085 |
| 2017/0328151 | A1* | 11/2017 | Dillard | E21B 21/08 |

* cited by examiner

REAL TIME FLOW ANALYSIS METHODS AND CONTINUOUS MASS BALANCE AND WELLBORE PRESSURE CALCULATIONS FROM REAL-TIME DENSITY AND FLOW MEASUREMENTS

CROSS-REFERENCE TO PENDING APPLICATIONS

This application claims priority to U.S. Provisional Patent Application Nos. 62/643,881, filed Mar. 16, 2018, Ser. No. 62/580,271, filed Nov. 1, 2017, and Ser. No. 62/472,351, filed Mar. 16, 2017, and U.S. patent application Ser. No. 15/588,631 filed May 6, 2017, which was a conversion of U.S. Provisional Application Ser. No. 62/332,809, filed May 6, 2016, each of which are incorporated herein by reference.

BACKGROUND

This disclosure relates to systems and methods intended to monitor, in real time, drilling or circulation performance of a well—such as, but not limited to, an oil well, a gas well, an injection well, and a geothermal well—calculate drilling or circulation performance results and parameters, and display the performance results and parameters to an operator or send commands or signals to computerized controls to manage and control drilling and circulation performance.

More particularly, this disclosure is in the field of managed pressure drilling. Over-balanced managed pressure drilling ("MPD") is a technique that tries to control the annular pressure throughout a wellbore by making adjustments that keep this pressure above the formation fluid pressure—to prevent formation fluids from entering the wellbore—but below the pressure at which the formation can begin to fracture. The decision to make an adjustment using current systems and methods is based on a spreadsheet, called a trip sheet, that assumes an average mud density at well depths and makes use of various drilling formulas known in the art.

SUMMARY

Embodiments of a system and method for real-time monitoring of a drilling or circulating system of a well include inlet-side flow measurement on a suction or discharge side of a pump to the well and outlet-side flow measurement from the well. In some embodiments, the flow measurement may be done by way of a mass flow meter. A set of computer executable instructions stored on non-transitory computer readable medium and executed by a microprocessor use a control volume and the collected or calculated mass flow and density data to continually determine a mass balance of the drilling or circulating system, the density data being adjusted for temperature and pressure.

In embodiments, the system and method may be used to continually monitor and control wellbore pressures to achieve over-balanced managed pressure drilling ("MPD"). In some embodiments, the system and method may be used as a fluid tracking engine. In other embodiments, the system and method may be used to accurately track a fluid caliper intended to survey the well to determine string volumes or borehole volumes; an example is determining the volume of cement needed to circulate the cement or bring the cement up to desired height. The system and method may be used to track the effects of mixing. The system and method may also be used as a viscometer.

BRIEF DESCRIPTION OF THE DRAWINGS

FIG. 4 is a screenshot presenting cumulative cuttings returns at surface and rate.

FIG. 5 is a screenshot presenting cumulative cuttings returns and new hole.

FIG. 6 is a screenshot presenting hole depth cuttings ratios.

FIG. 7 is a screenshot presenting lagged depth returns.

FIG. 8 is a screenshot presenting lagged depth cuttings ratio.

FIG. 9 is a screenshot presenting lagged depth volumes pumped.

FIG. 10 is a screenshot presenting lagged depth durations.

FIG. 11 is a screenshot presenting bit depths and coiled tubing speeds.

FIG. 12 is a screenshot presenting wiper trips and trip effects.

FIG. 13 is a screenshot of the input side mass flow rate, density, temperature and volume.

FIG. 14 is a screenshot of the output side mass flow rate, density, temperature, and volume.

FIG. 15 is a screenshot showing the mass balance.

FIG. 16 is a screenshot showing the volume balance.

FIG. 17 is a screenshot showing the sweeps in 2D and 3D format. Different color coding may be used in the 3D model to indicate where the sweep is located.

FIG. 18 is a screenshot showing the wellbore velocity.

FIG. 19 is a screenshot showing the wellbore direction and dimensions.

FIG. 20 is a screenshot showing the coiled tubing and bottom hole assembly dimensions.

FIG. 21 is a screenshot showing data sources and health.

FIG. 22 is a screenshot showing hole forecast time to depth relative to a best fit target and upper and lower bounds.

FIG. 23 is a screenshot showing a sample tracker for fluid tracking within a wellbore (see also FIG. 17). The tracker provides an estimated time of arrival of the sample to surface.

FIG. 24 is a screenshot showing user-inputted sampling depths and intervals for the sample tracker. Audible alerts may be set.

FIG. 25 is an annotated embodiment of a managed pressure drilling screen display.

FIG. 26 is an annotated screenshot showing fluid caliper within a wellbore using embodiments of this disclosure.

FIG. 27 is an annotated screenshot showing the effects of mixing.

ELEMENTS AND NUMBERING USED IN THE DRAWINGS AND DETAILED DESCRIPTION

Figure 1:
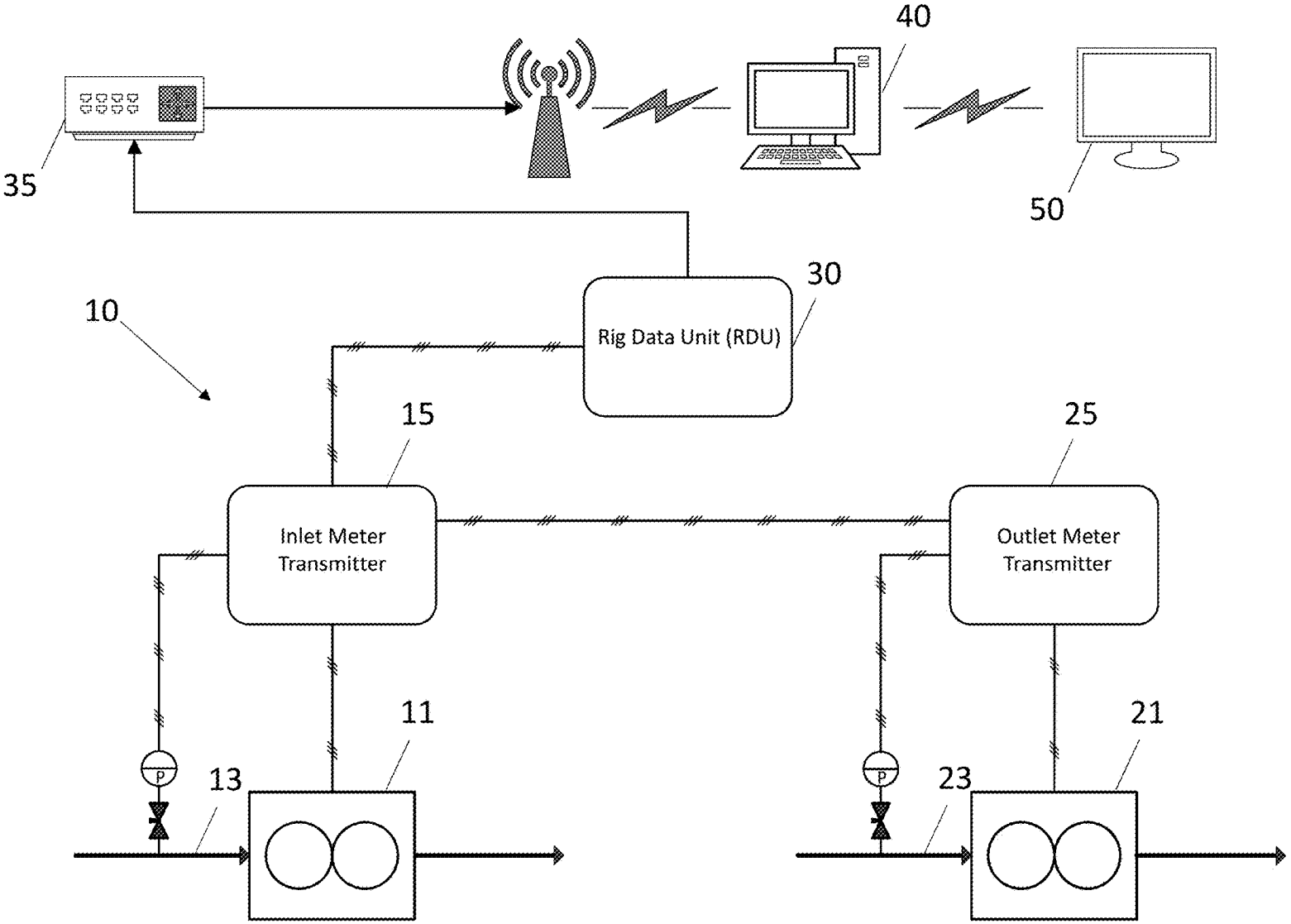
FIG. 1 is diagram that illustrates hardware interfacing with mass flow meters and analytical processing over a network. The analytical processing includes a microprocessor and software that use a control volume and the collected mass flow and density data to calculate a mass balance of the drilling or circulating system, the density data being adjusted for temperature and pressure.

10 System and method
11 Inlet side mass flow meter
13 Suction or discharge side of pump
15 Inlet side meter transmitter
21 Outlet side mass flow meter
23 Flow line
25 Outlet side meter transmitter
30 Data acquisition, processing, and network interface (rig data unit)
35 Network router
40 Microprocessor with associated software
50 Display

DETAILED DESCRIPTION

Referring to FIG. 1, embodiments of a system and method 10 to monitor a drilling or circulation system using mass balance includes flow measurements such as, but not limited to, an inlet mass flow meter 11 located on the suction or discharge side 13 of a pump and an outlet mass flow meter 21 mounted on a flow line 23, such as, but not limited to, a managed pressure drilling line or gravity line. Each meter 11, 21 interfaces with its own analog, or digital, and analog and digital inputs transmitter 15, 25 which, in turn, is connected to a network interface or rig data unit 30. WELLWORC™ field data acquisition and monitoring hardware (WellWORC, Inc., Houston, Tex.) or its equivalent is suitable hardware for use in this system and method.

Data collection through the meters 11, 21 may be equilibrated by any suitable algorithm for that purpose. For example, in some embodiments one meter 11, 21 is biased to the other meter 21, 11 in order to account for differences in the meters.

Analytical processing means such as a computer 30 and/or 40 having a microprocessor and associated software (non-transitory computer readable medium) executes real time analytical processing of the collected mass flow and density data using Eqs. 1 to 4 below and displays analytical trends (see e.g. FIGS. 4 to 21) on a display 50. Display 50 may be located at the driller's station, or other locations onsite or offsite. Router 35 places the analytical processing means in network communication with the rig data unit 30.

Figure 3:
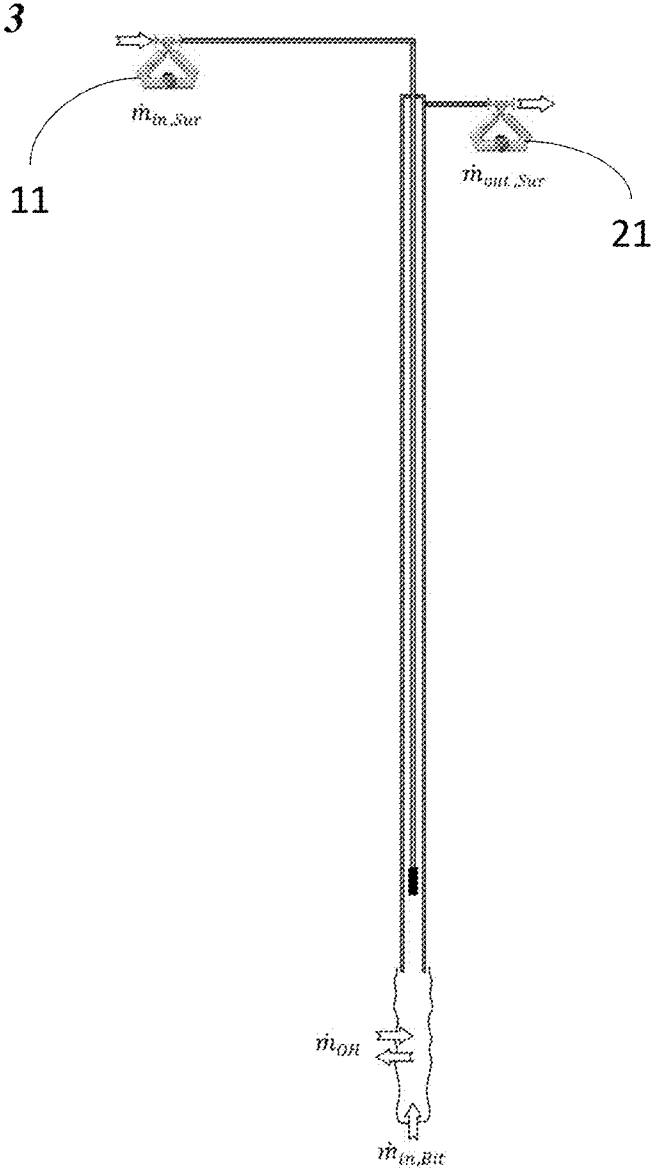
FIG. 3 is a diagram showing mass flow entering and leaving a rotary drilling system.
Figure 2:
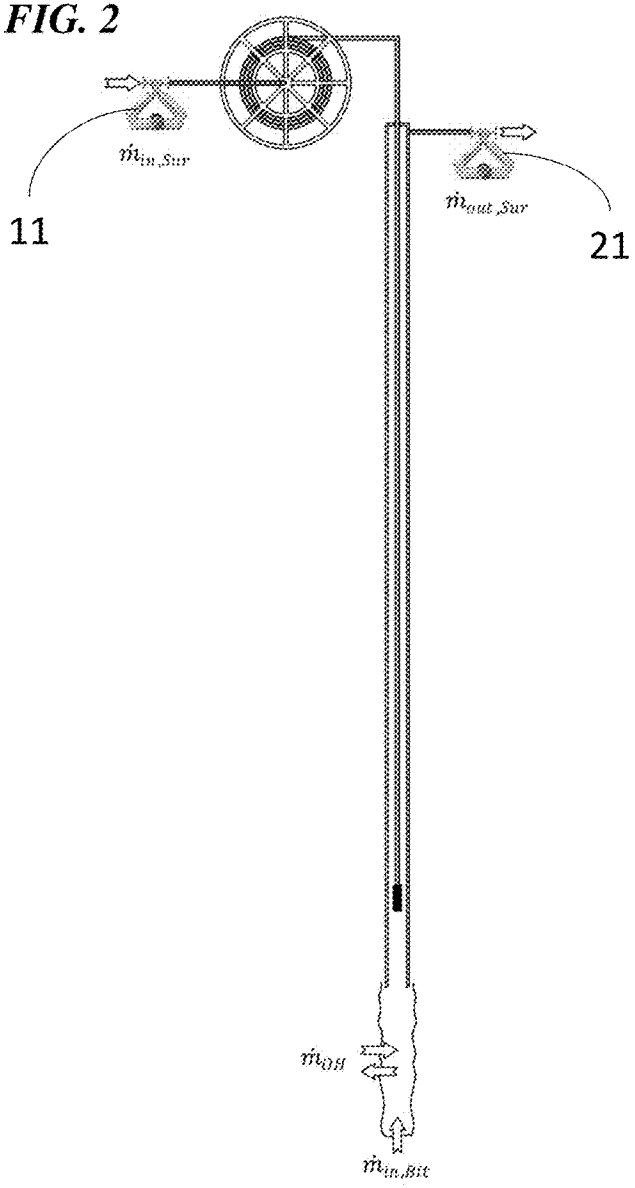
FIG. 2 is a diagram showing mass flow entering and leaving a coiled tubing drilling system.
Figure 4:
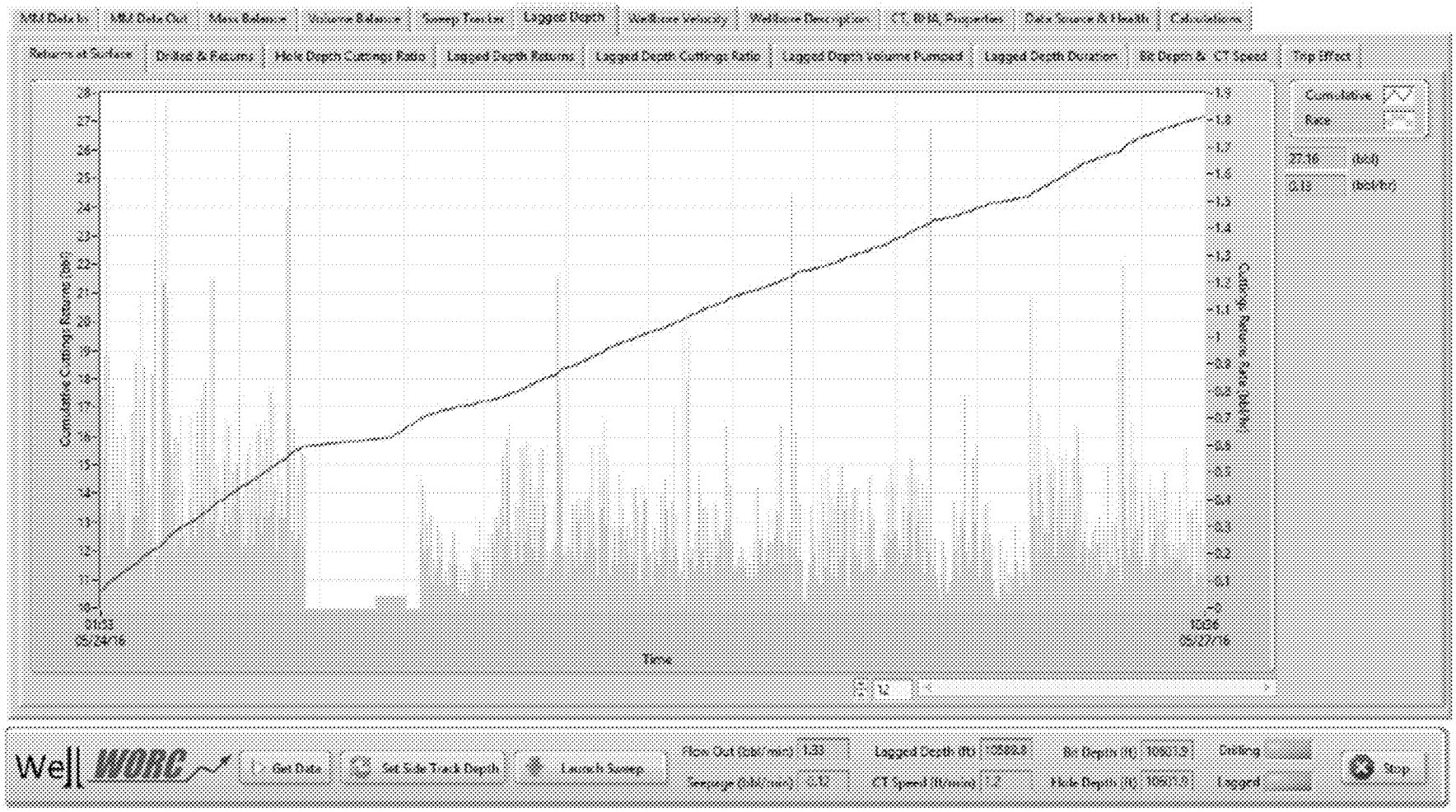
FIGS. 4 to 16 illustrate embodiments of graphical displays that present results of the analytical processing.
Figure 5:
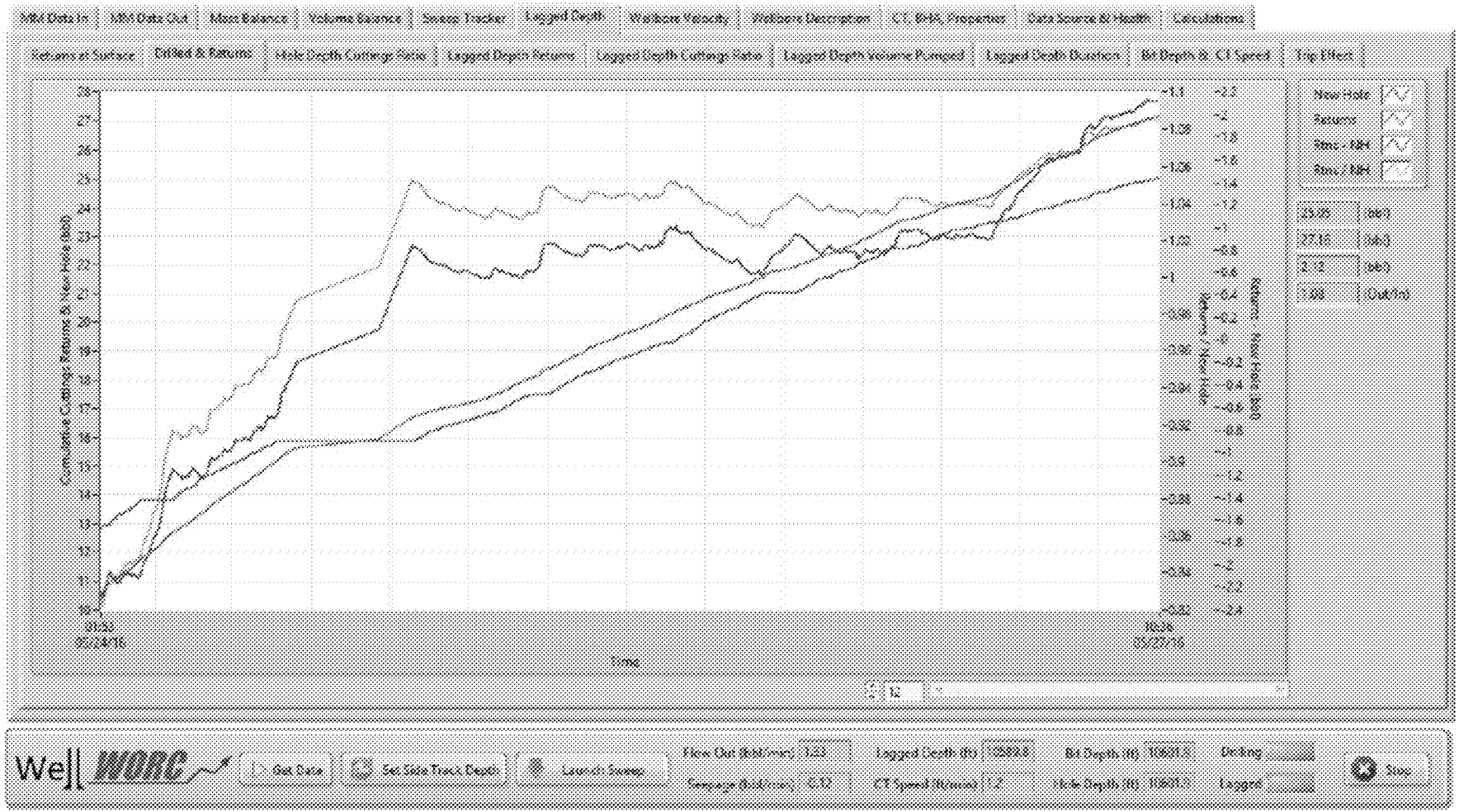
Figure 6:
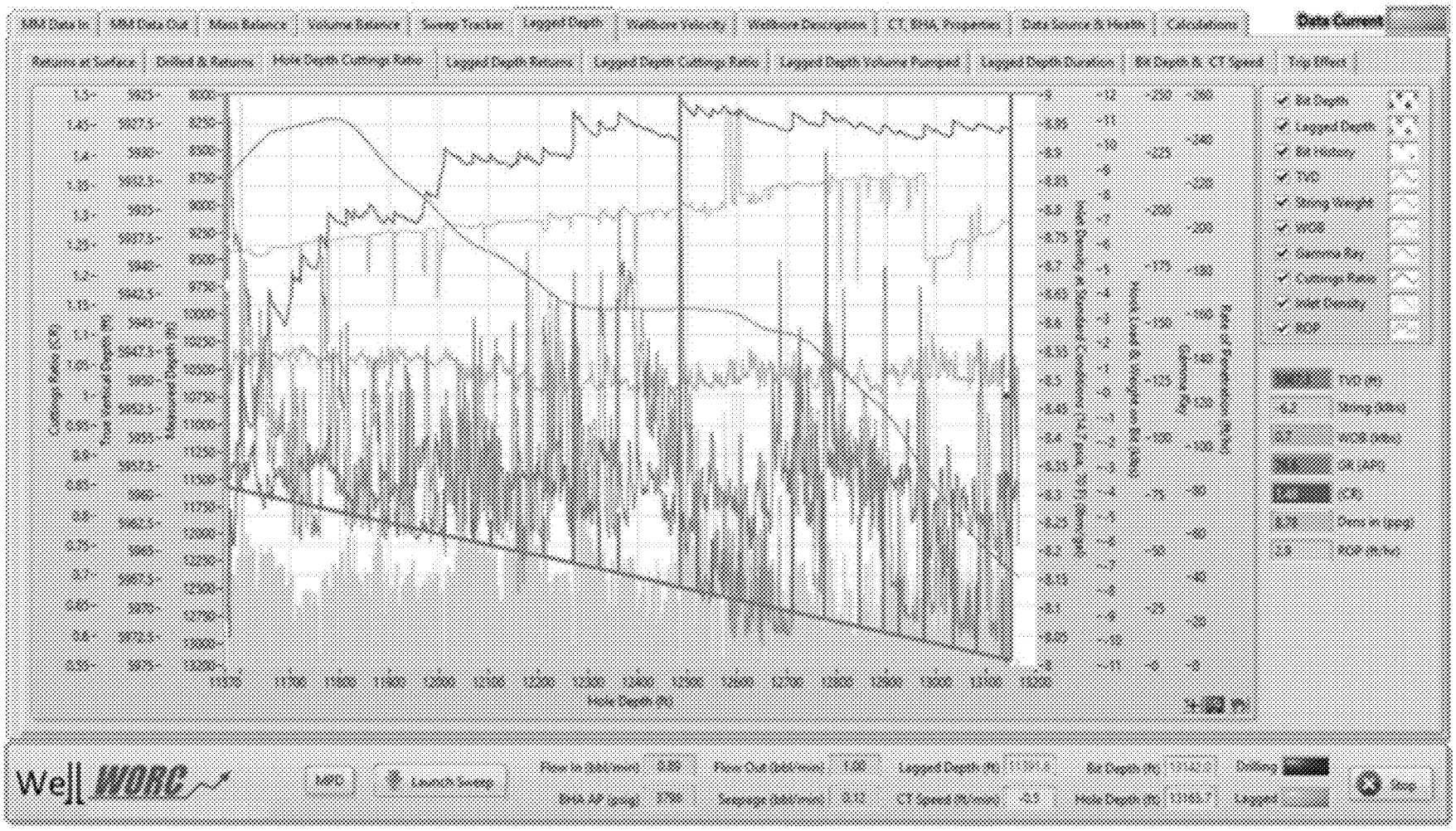
Figure 7:
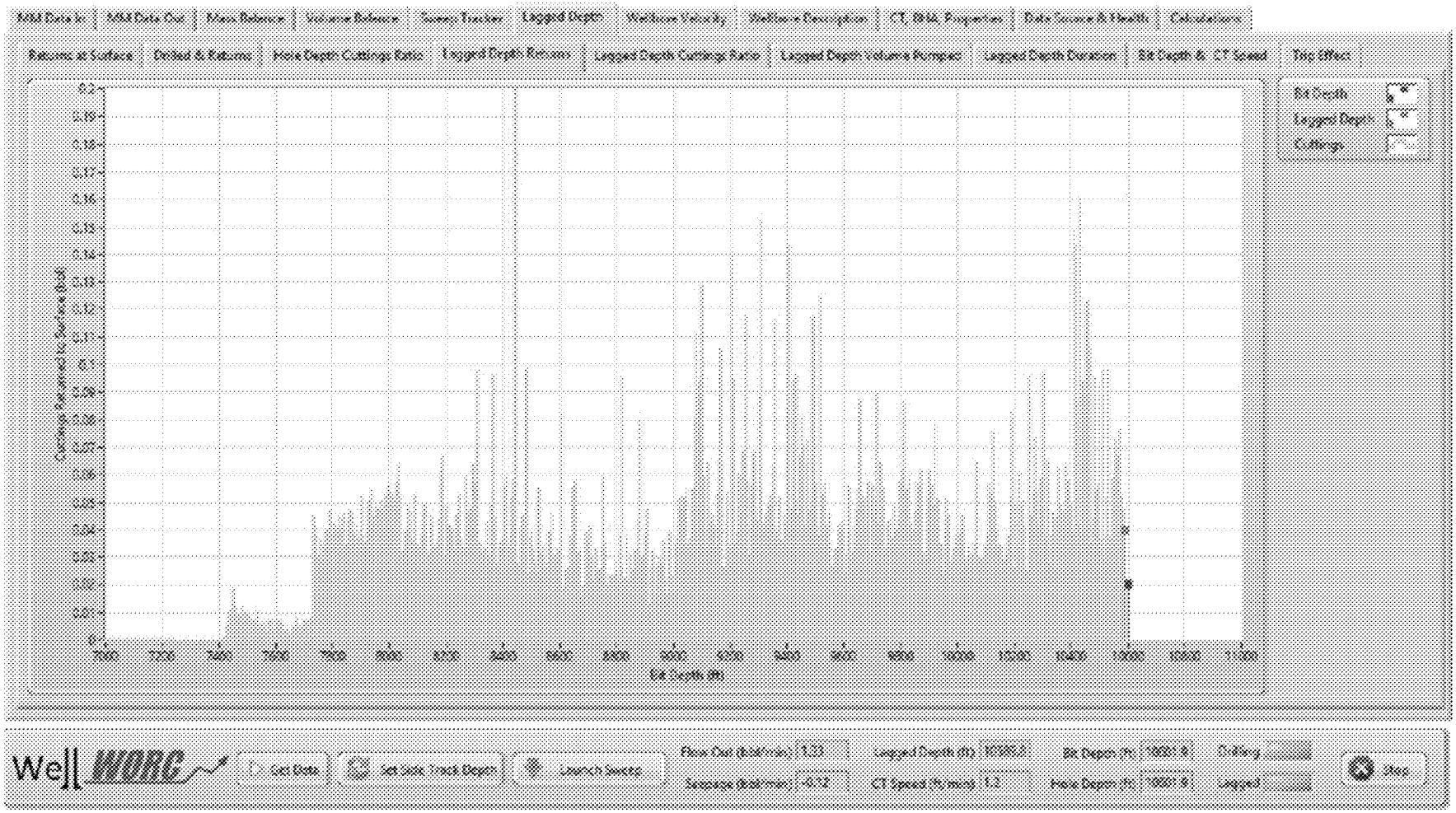
Figure 8:
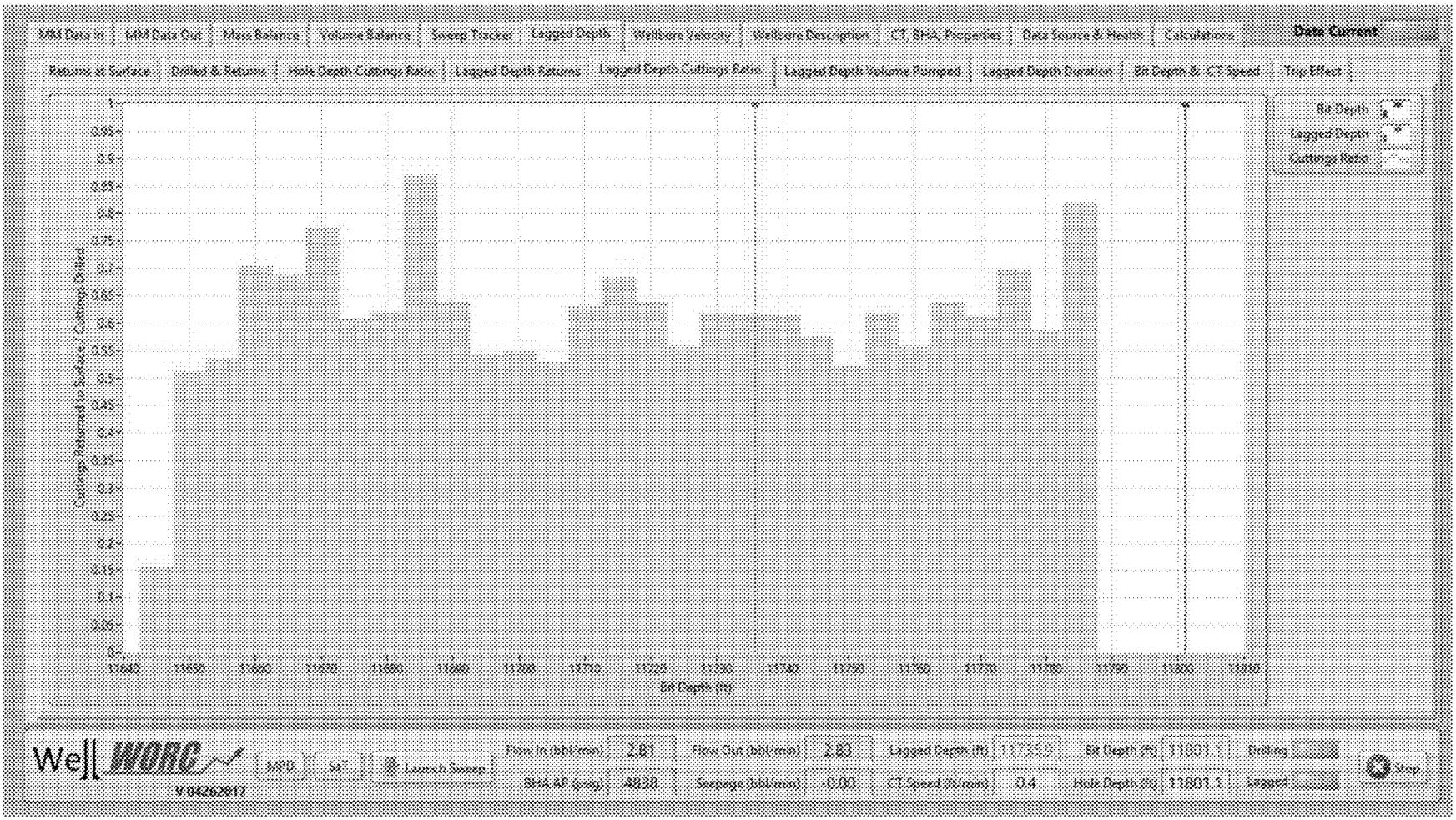
Figure 9:
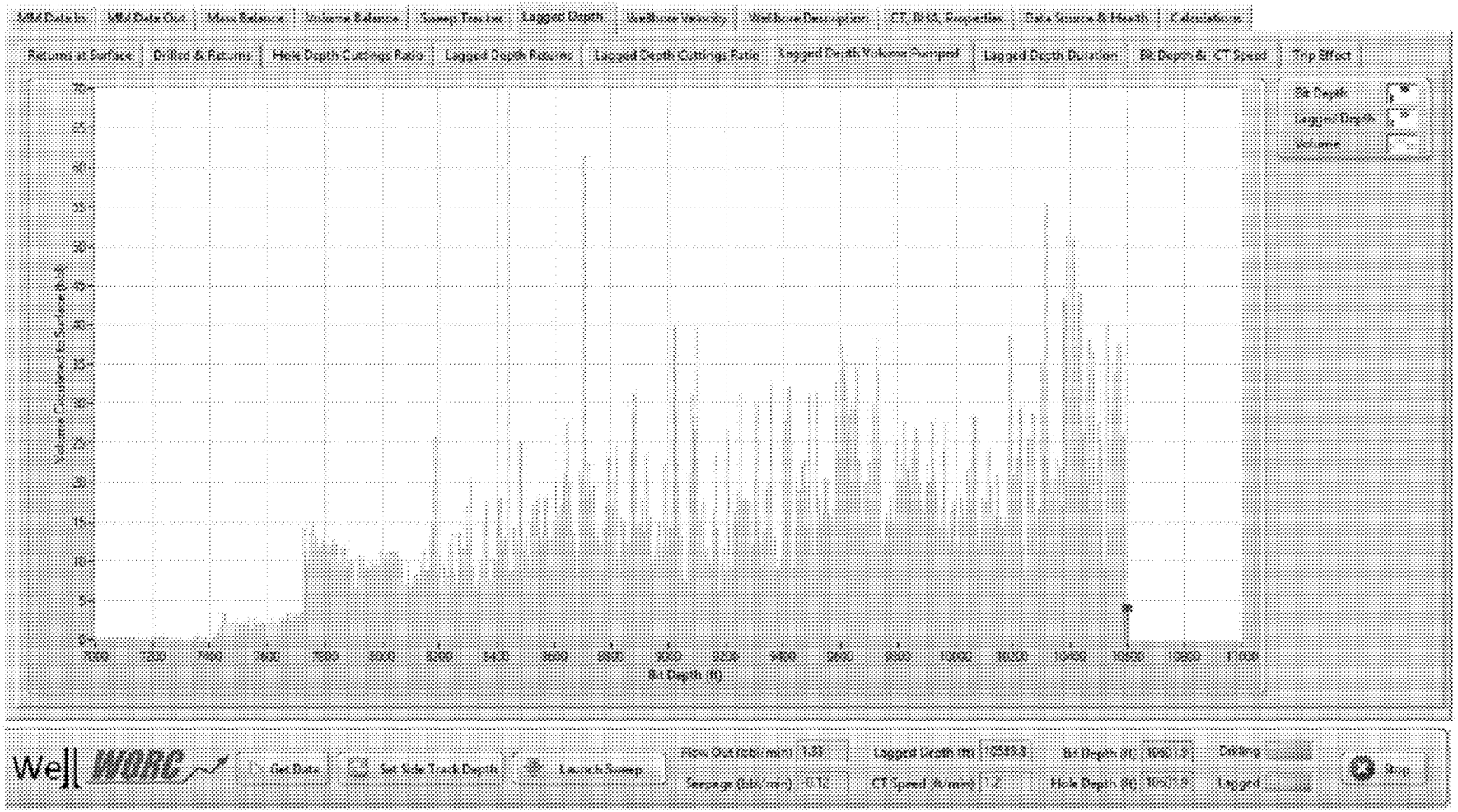
Figure 10:
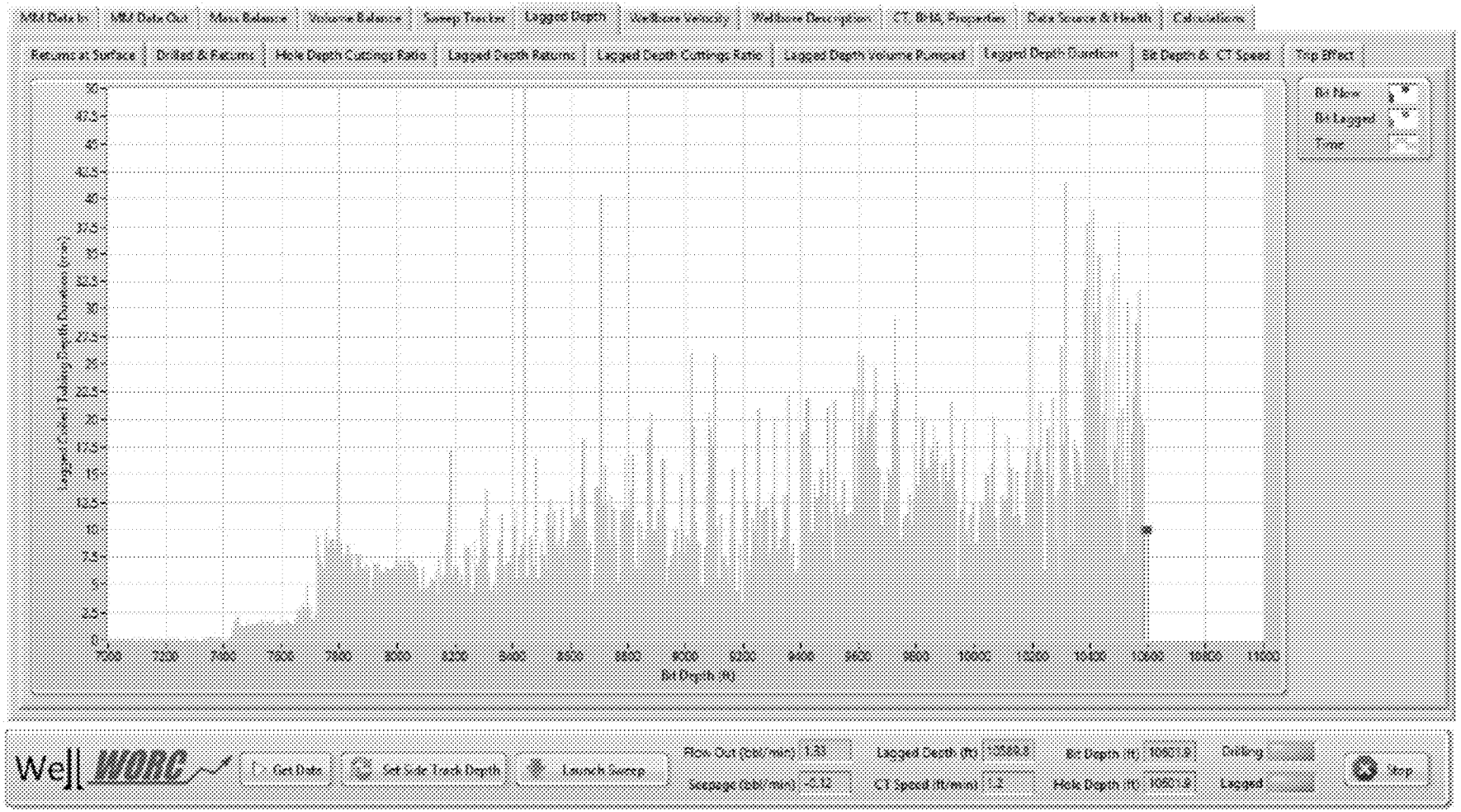
Figure 11:
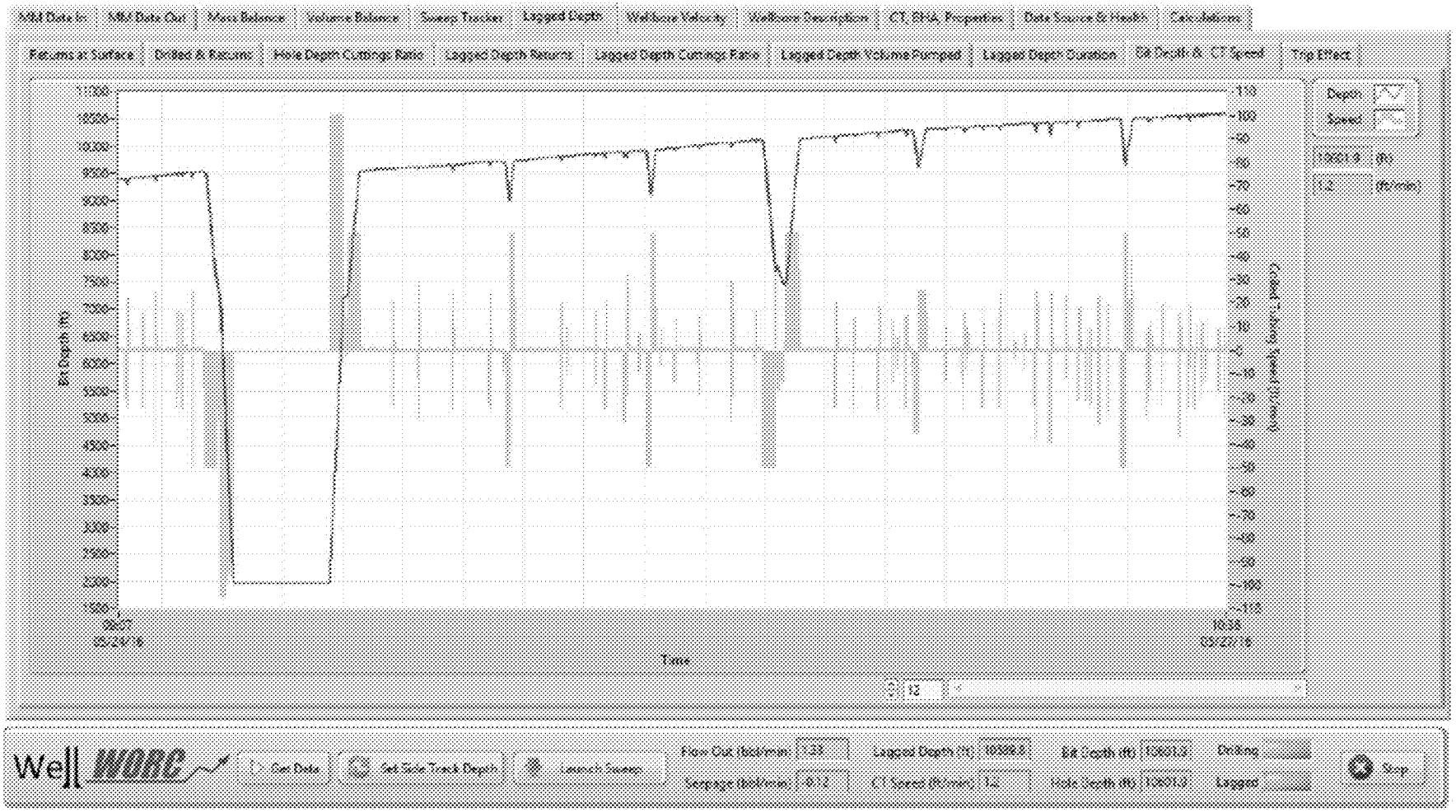
Figure 12:
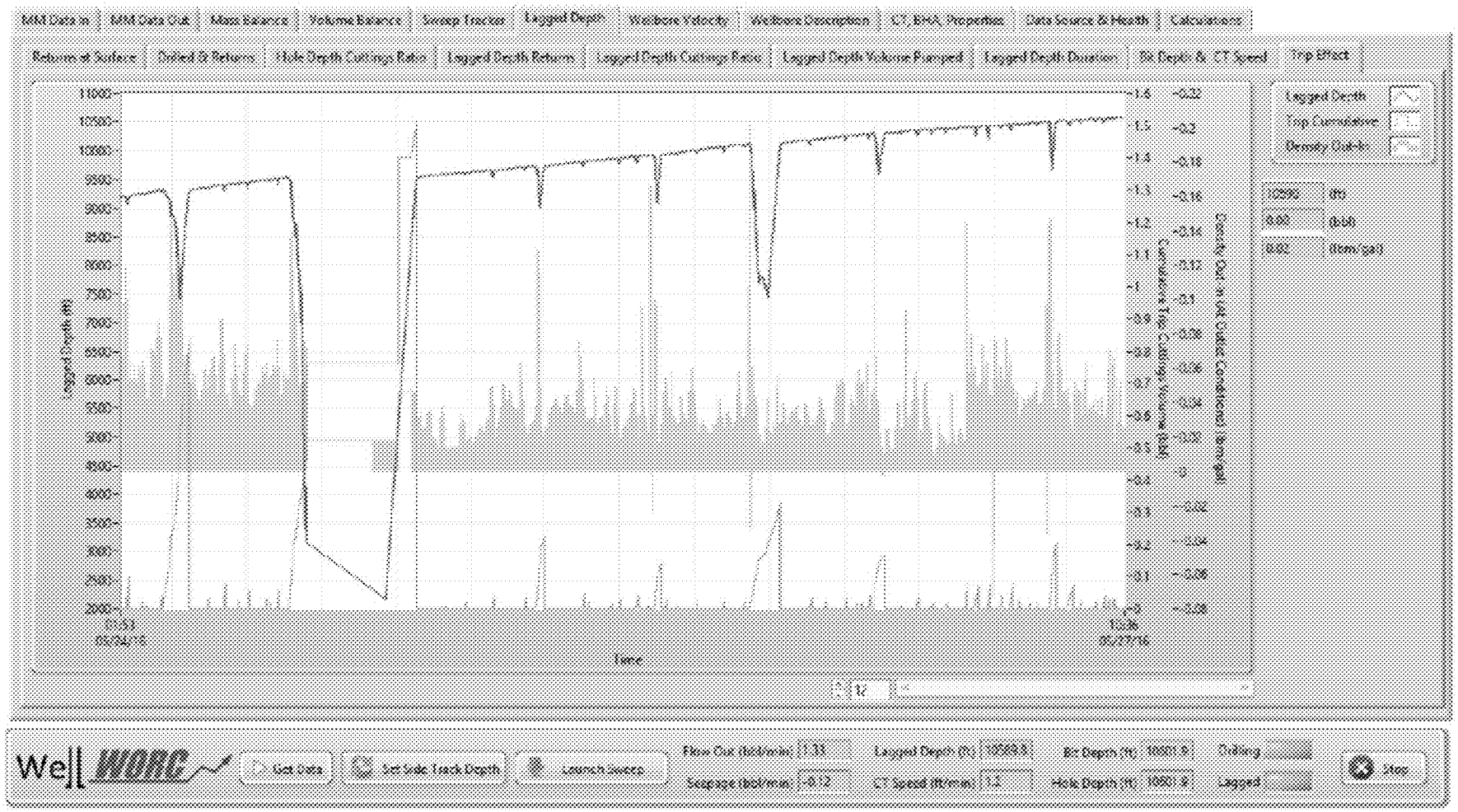
Figure 13:
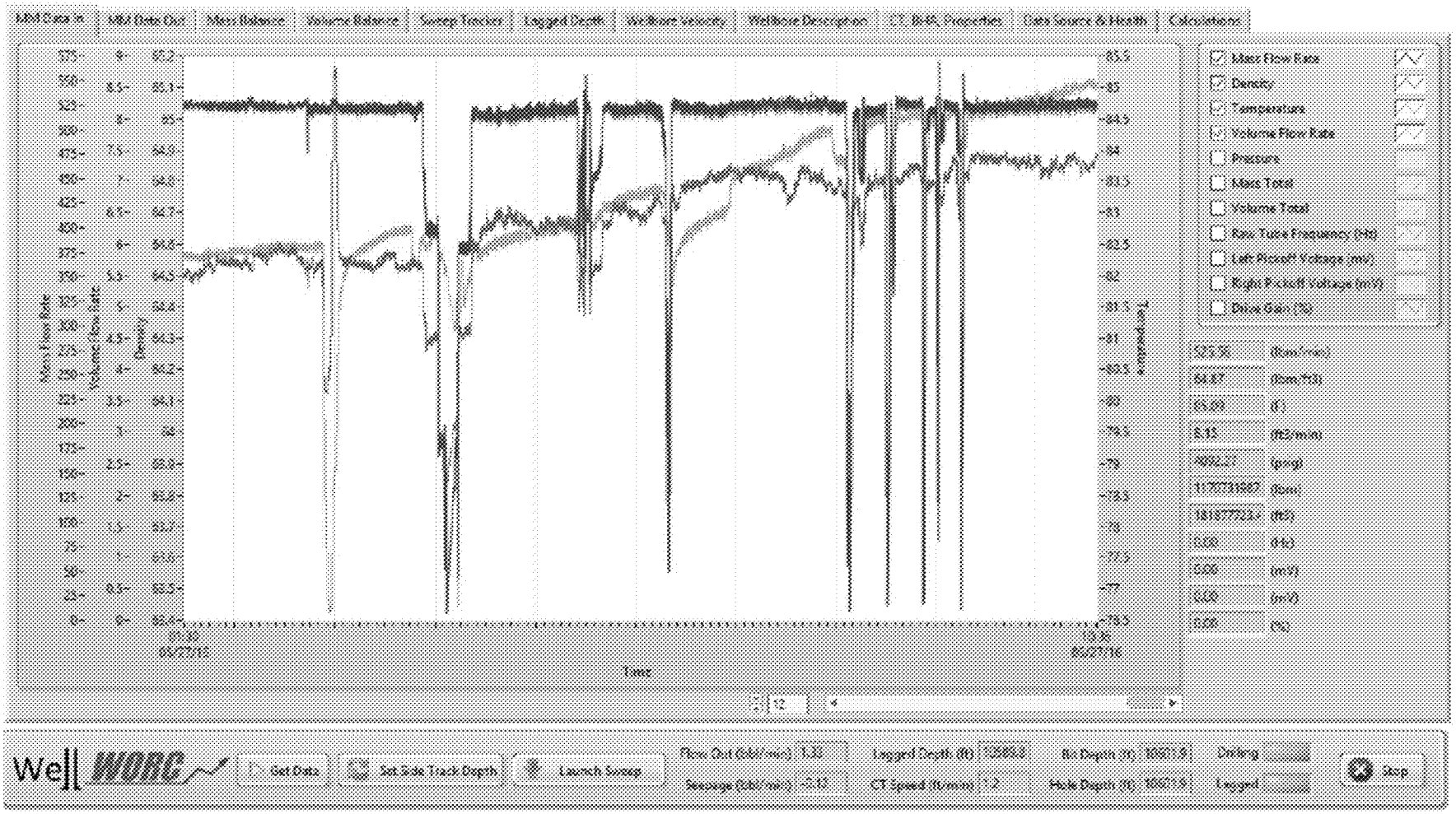
Figure 14:
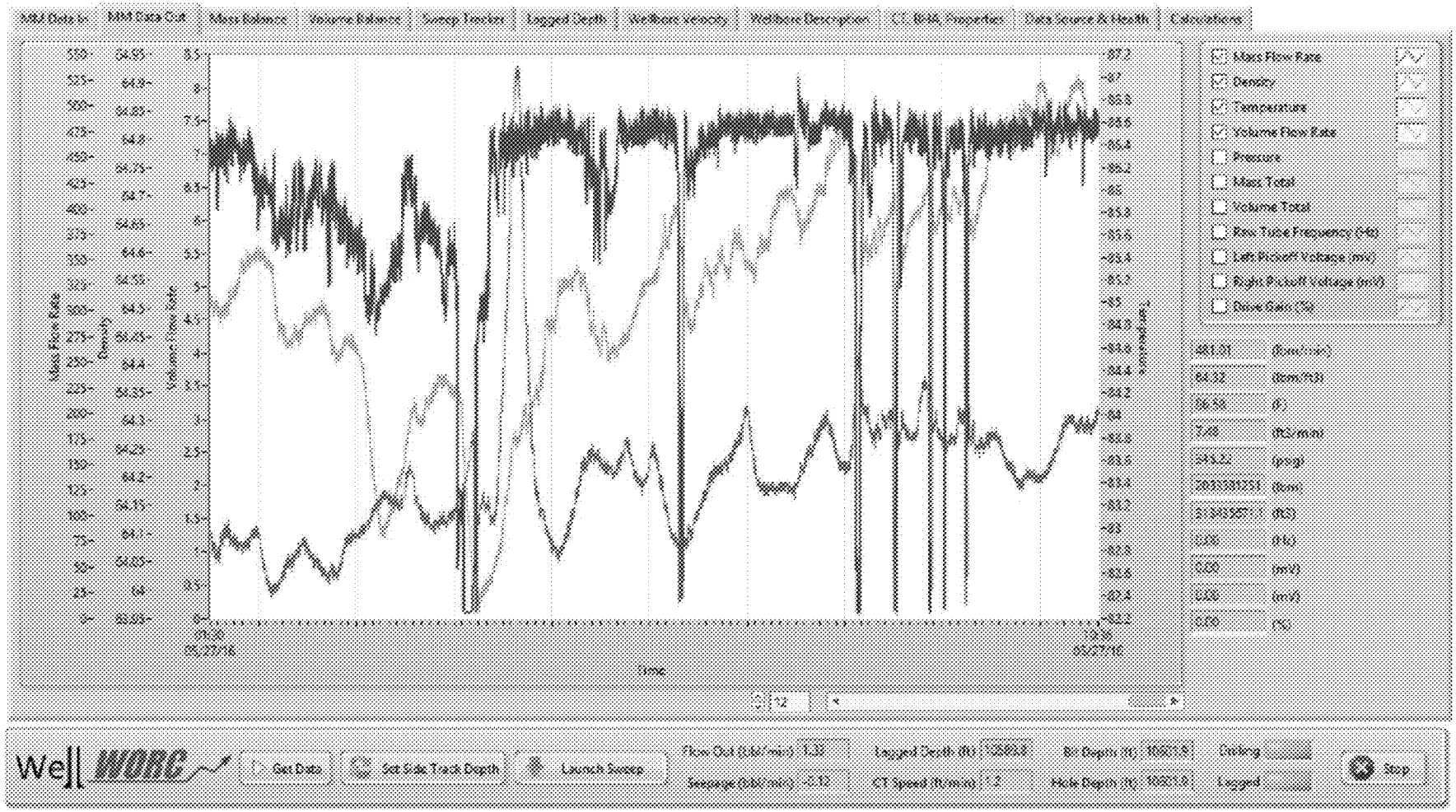
Figure 15:
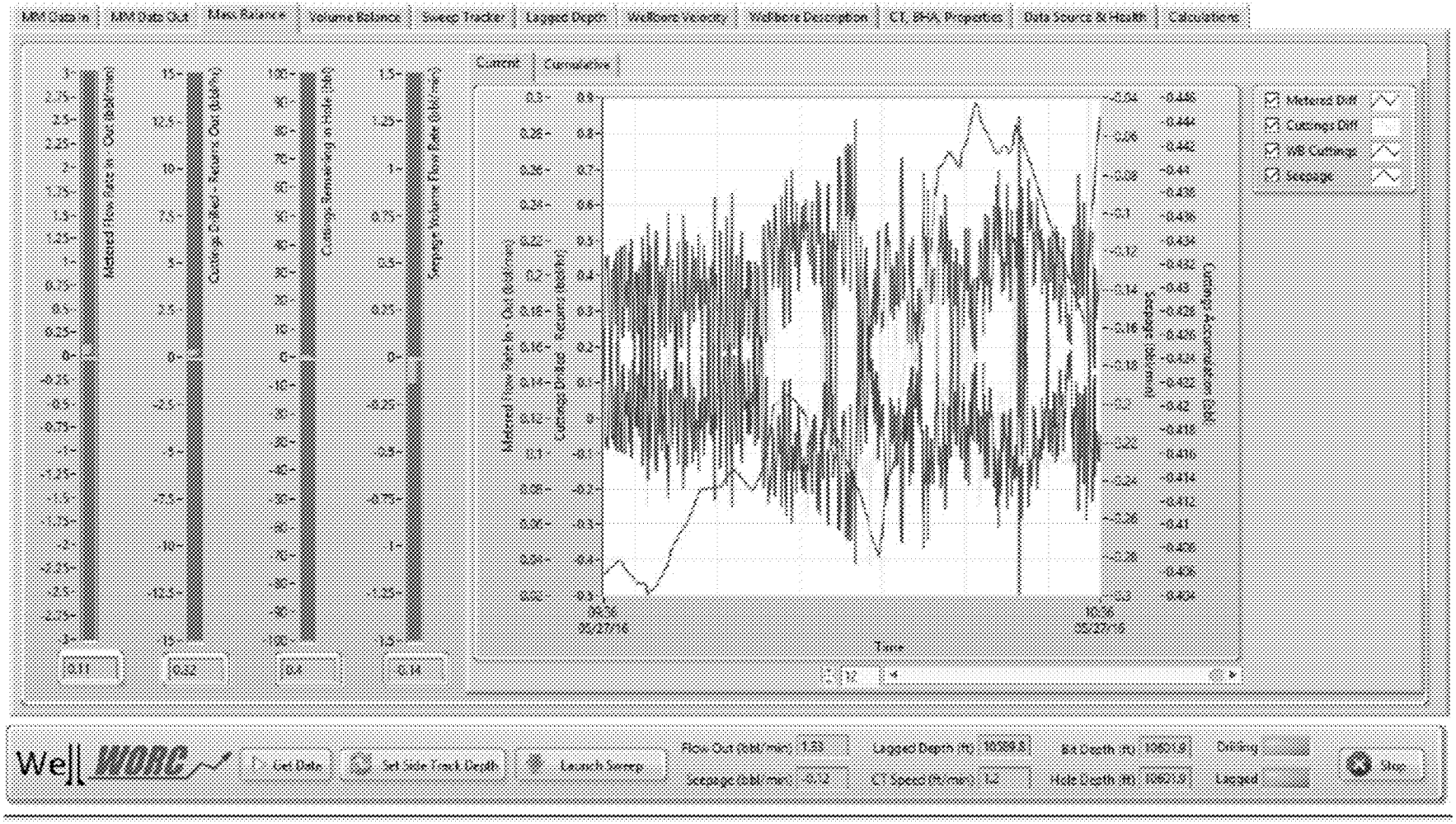
Figure 16:
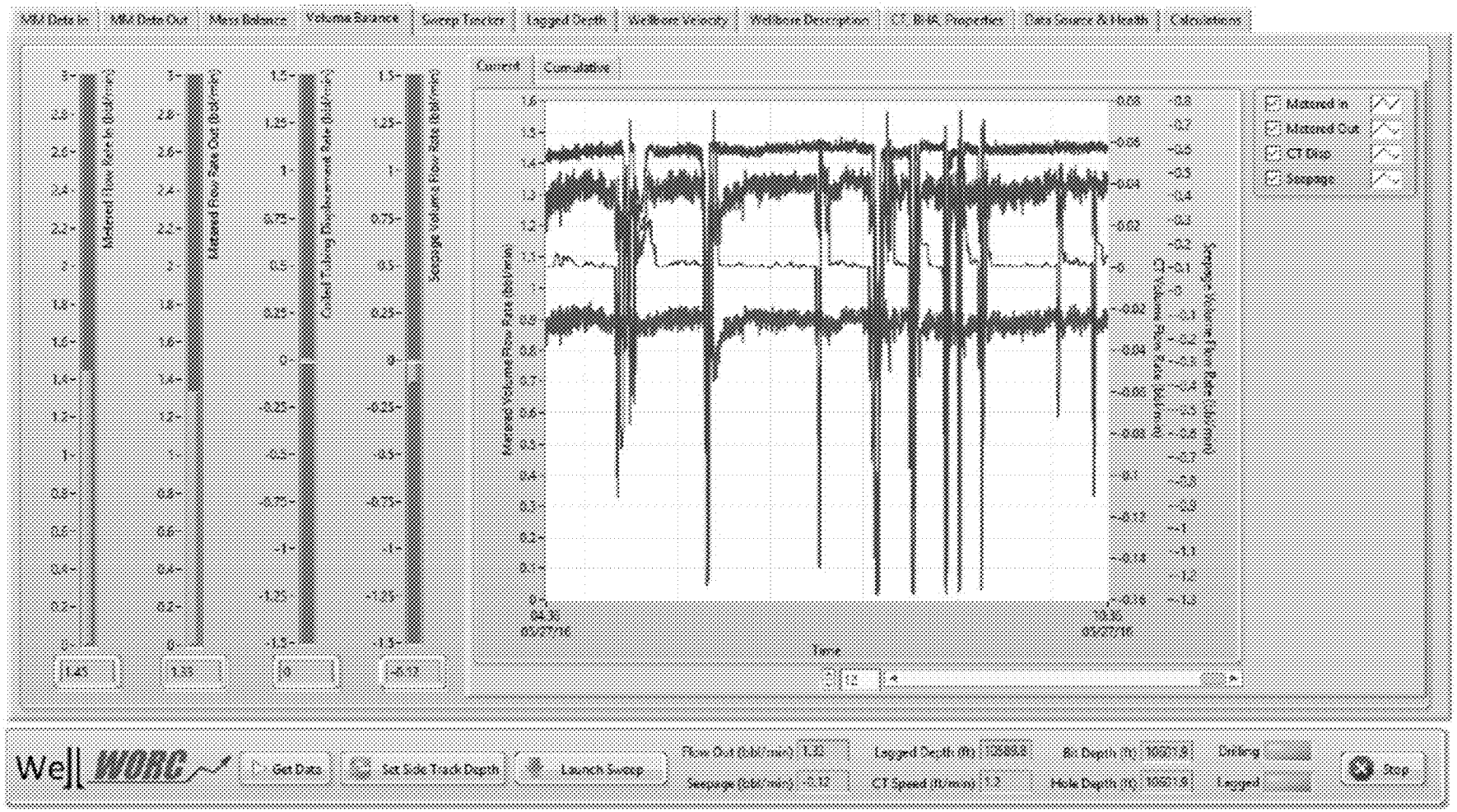
Figure 17:
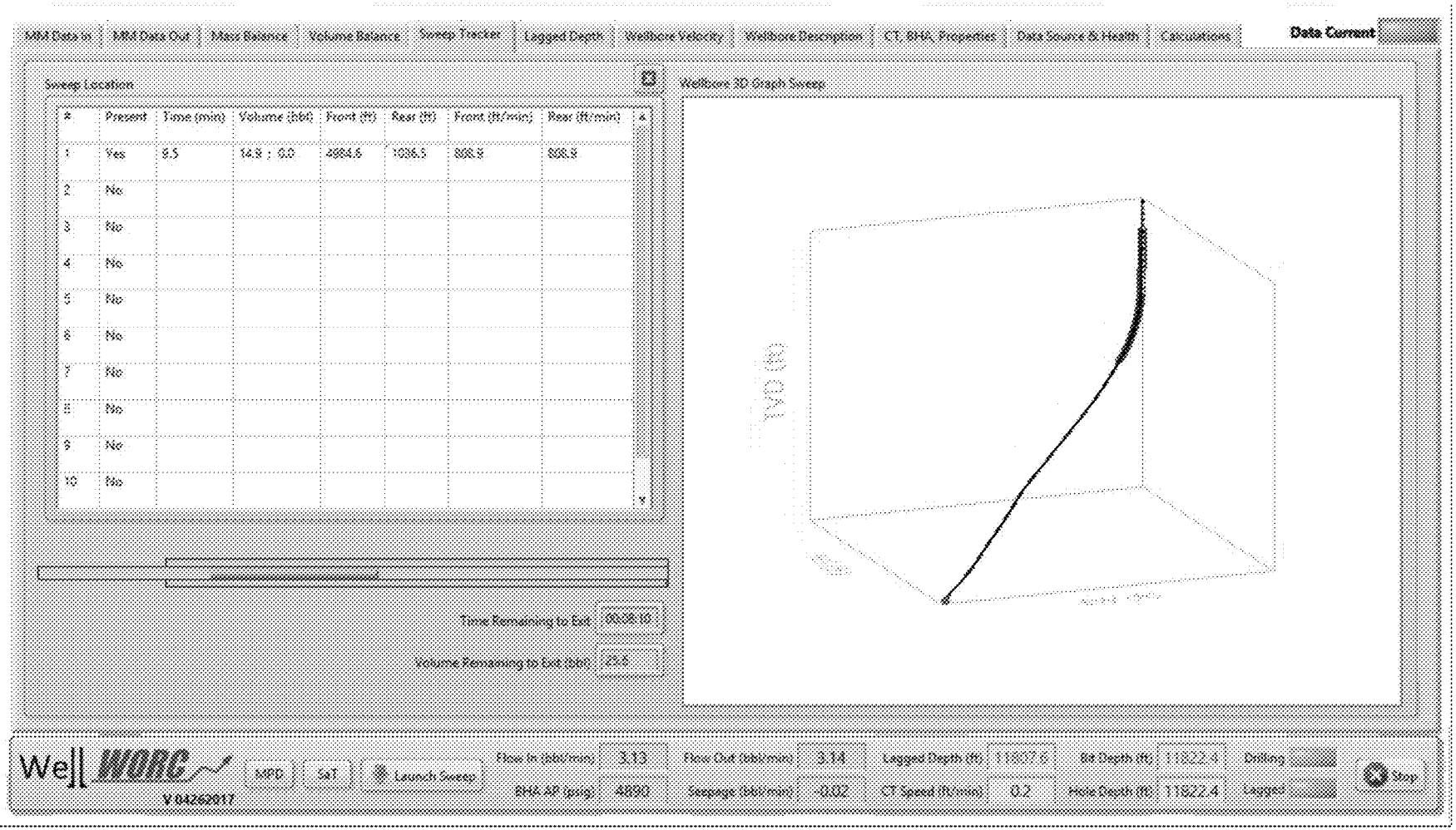
FIGS. 17 to 27 illustrate embodiments of displays of sweep tracking, sample tracking, wellbore velocities, data sources, time and volume calculations, and other properties of the well.
Figure 18:
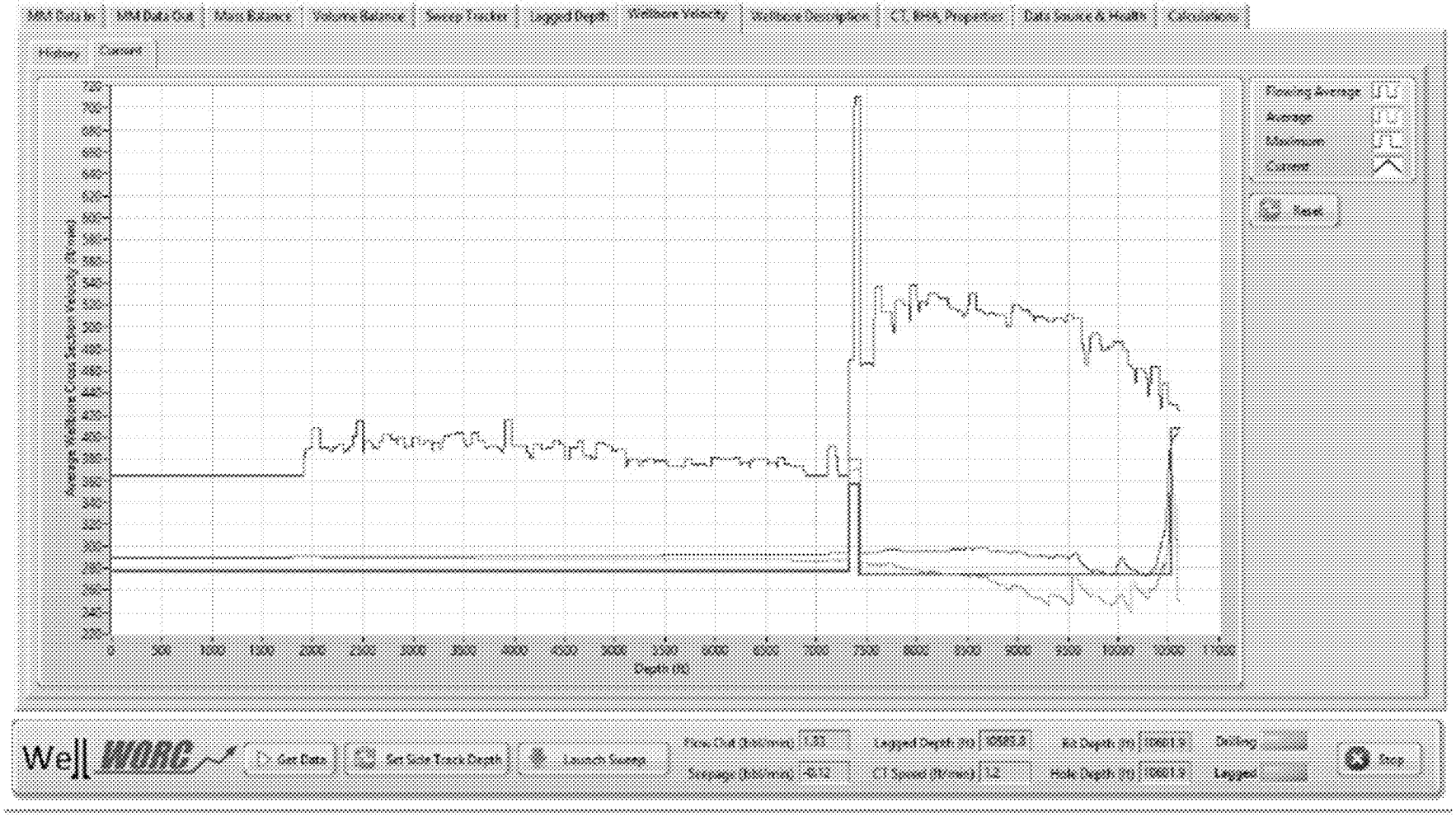
Figure 19:
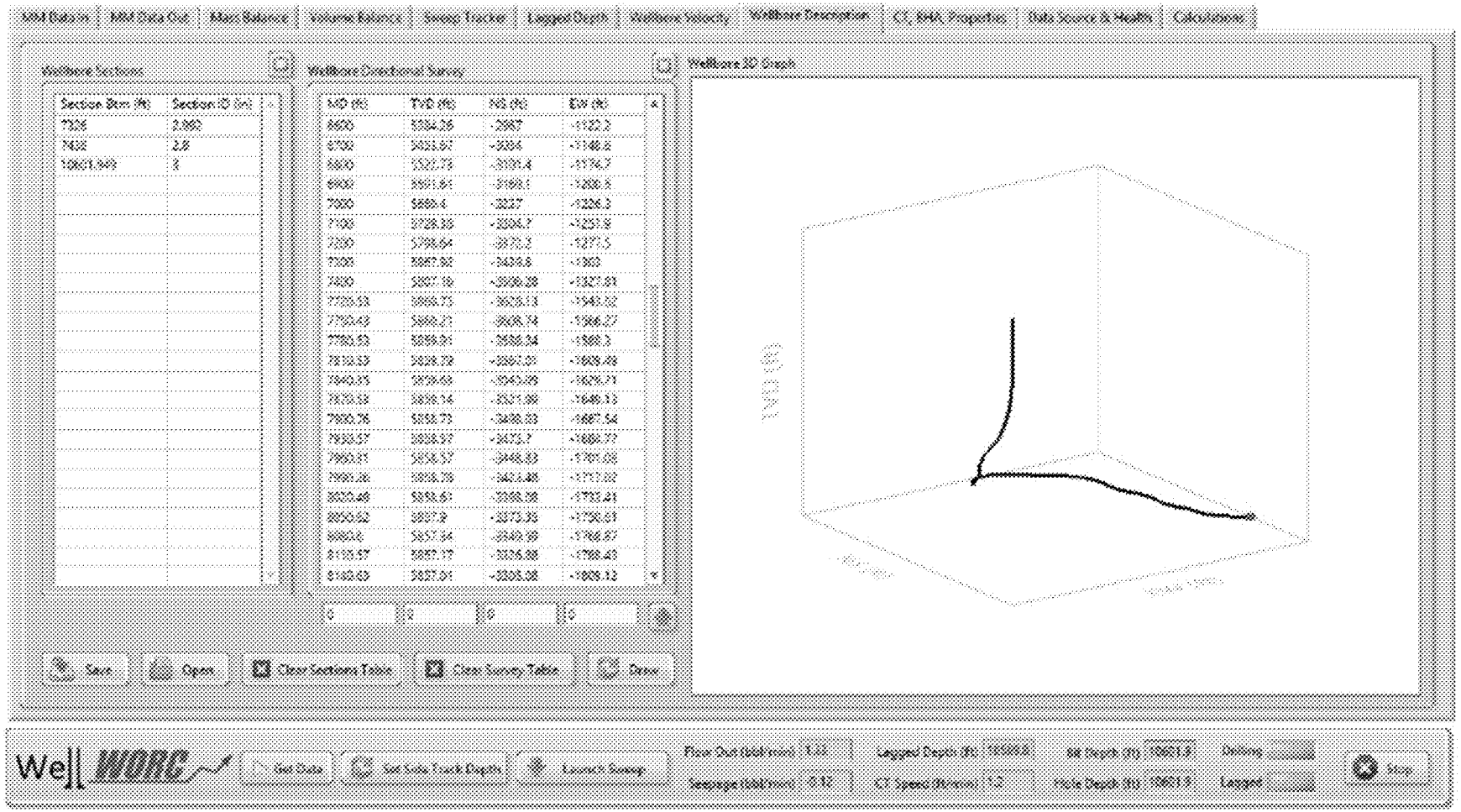
Figure 20:
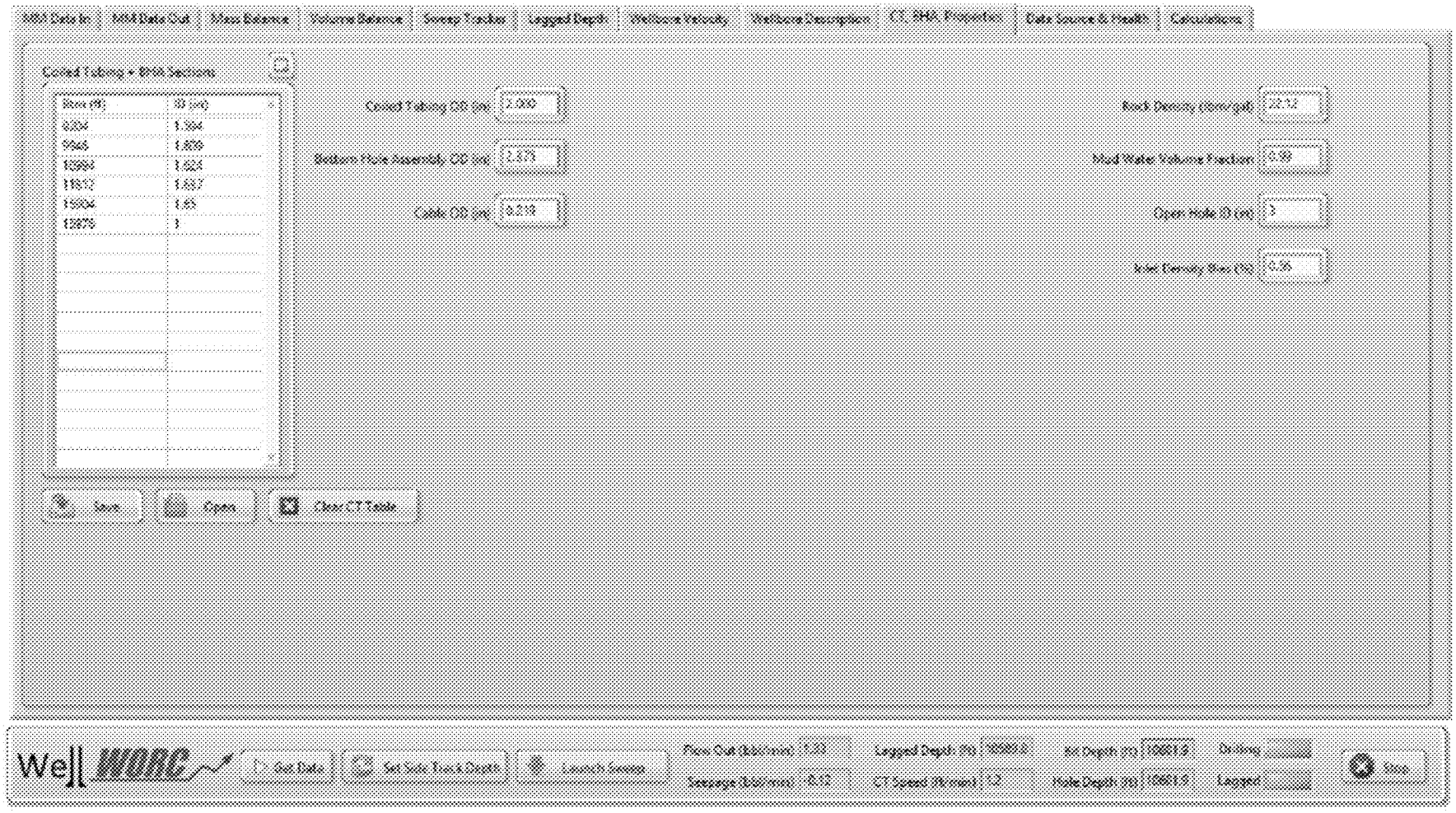
Figure 21:
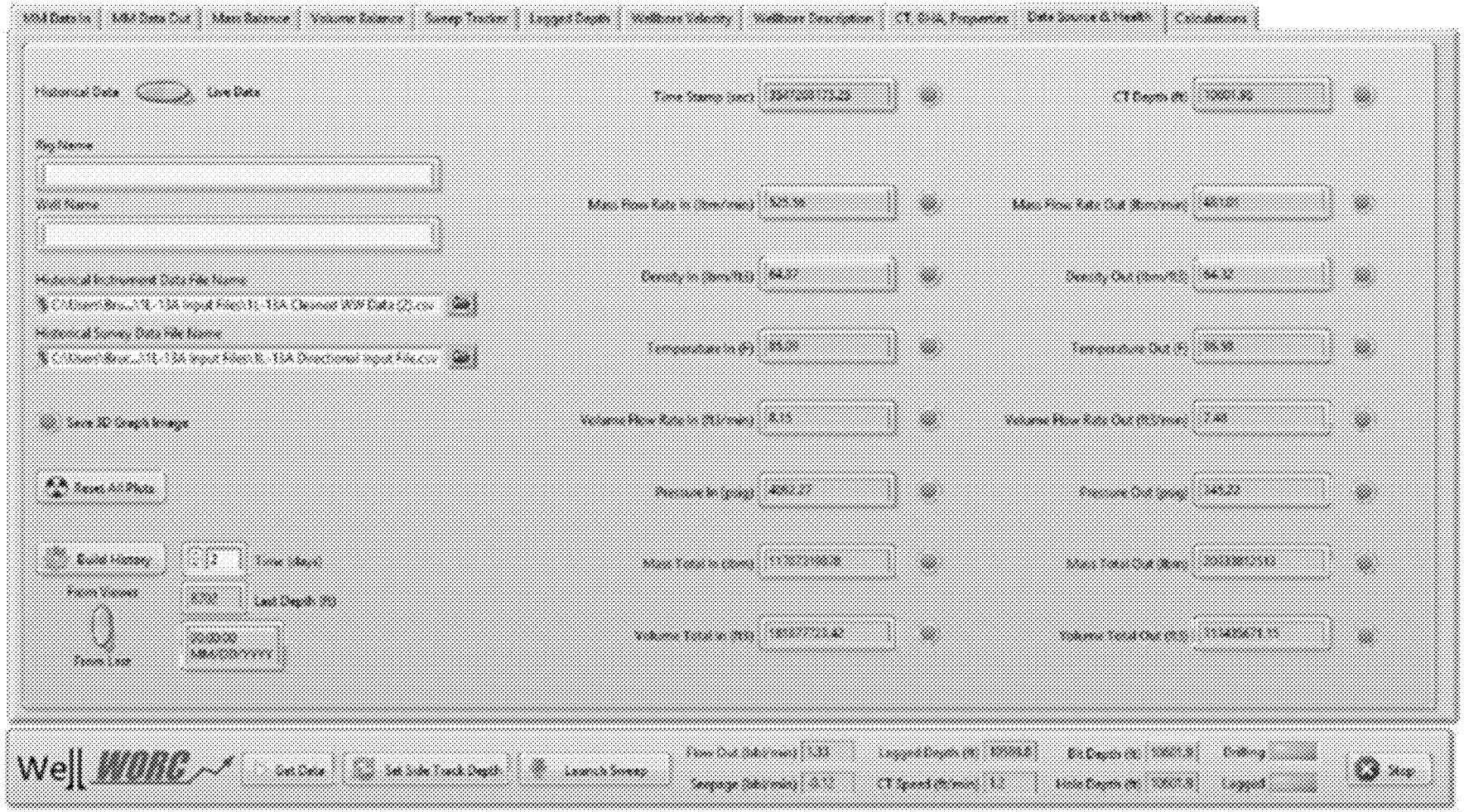
Figure 22:
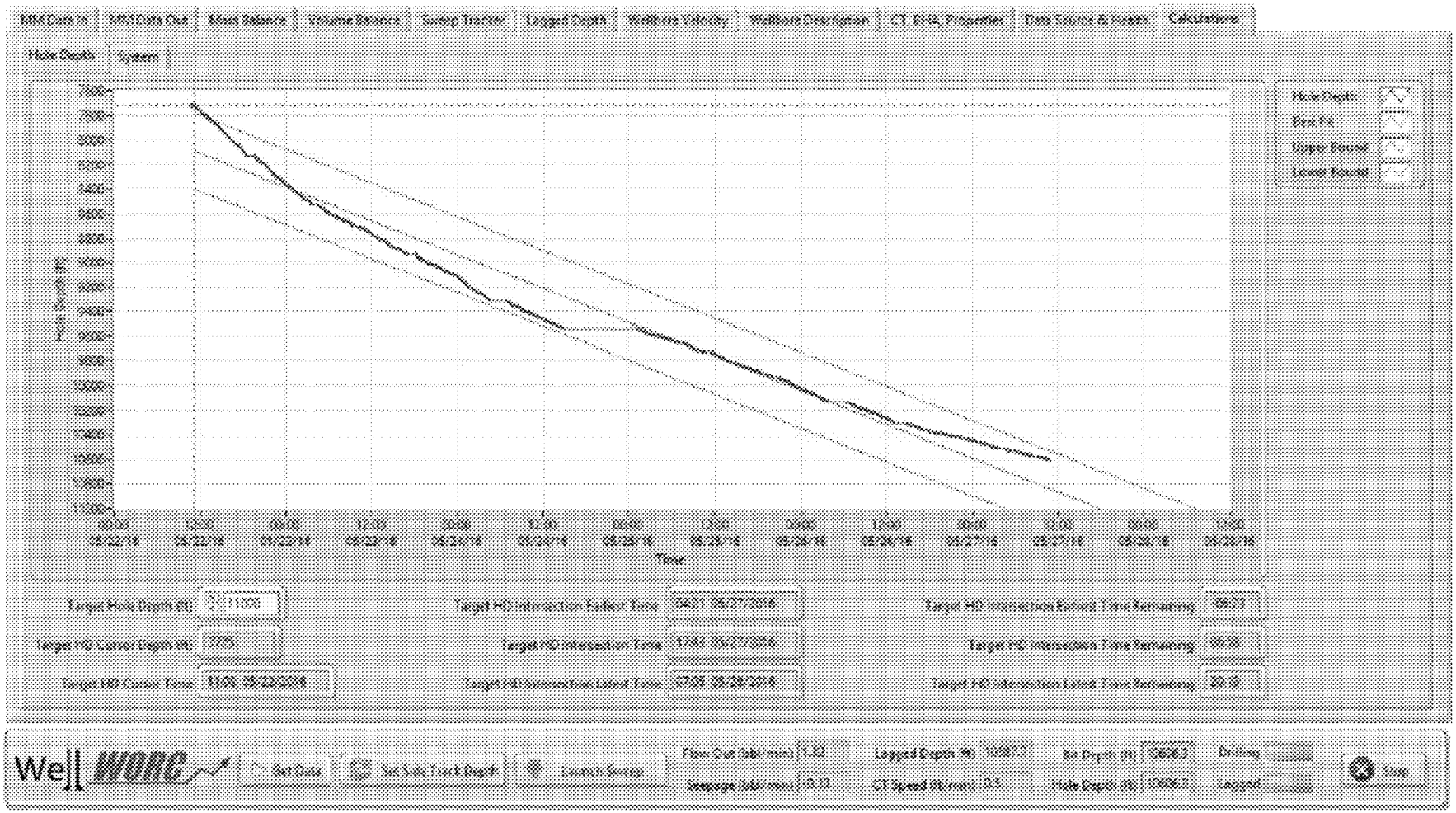
Figure 23:
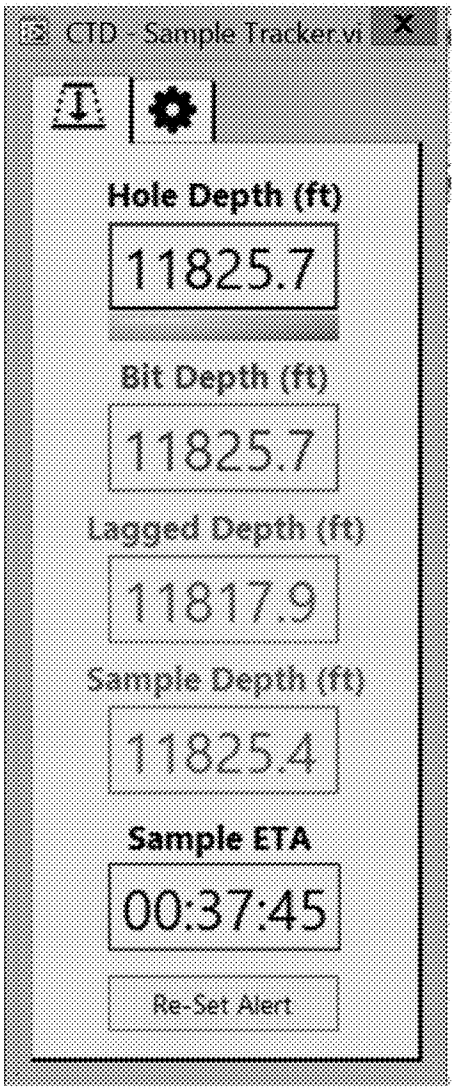
Figure 24:
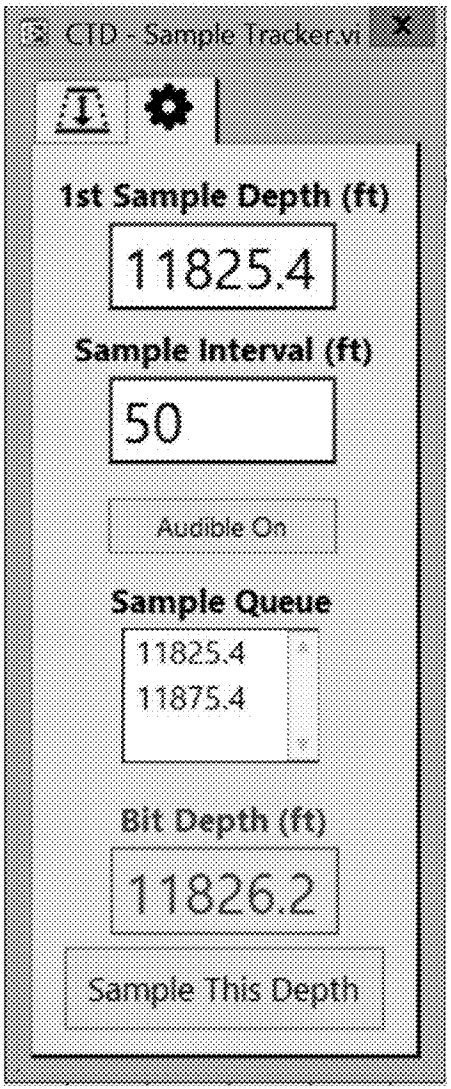

Referring to FIGS. 2 and 3, mass enters the system upstream of the coiled tubing spool or drill string, while the bit is making hole, and from the reservoir via the open hole section:

$$\dot{m}_{in}=\dot{m}_{in(surface)}+\dot{m}_{in(bit)}+\dot{m}_{in(open\ hole)} \quad \text{(Eq. 1)}$$

where $\dot{m}_{in(bit)}$=f(bit diameter, depth, cutting force, rock density, time). Mass can leave this system at the surface via the wellhead and to the reservoir via the open hole section:

$$\dot{m}_{out}=\dot{m}_{out(surface)}+\dot{m}_{out(open\ hole)} \quad \text{(Eq. 2)}$$

The control volume, accounting for mass balance, is the wetted wellbore volume V. The mass balance is:

$$\dot{m}_{in}=\dot{m}_{out}+\dot{m}_{accumulated} \quad \text{(Eq. 3)}$$

$$\dot{m}_{accumulated}=\dot{m}_{in}-\dot{m}_{out} \quad \text{(Eq. 4)}$$

Sampling of depths and measured values may occur at any sampling rate desired. In some embodiments, sampling of depths occurs at 1-foot intervals and sampling of measured values at 1 second intervals. In other embodiments, measured values sampling occurs at 5 second intervals. The data may be digitally stored as an array in a discrete data packet corresponding to each sampling interval.

Referring to FIGS. 4 to 24, real time monitoring and analytical processing of the mass system balance using data being collected by way of the mass flow meters provides at least the following drilling performance, parameters, indicators, or information:

- close approximation of cuttings recovery volume by mass balance, with metered mass flow and density, indicating the cuttings volumes circulated to surface at bottoms-up;
- trending of lagged bit depth compared to outflow;
- carrying capacity of the drilling mud to carry drill cuttings; an indicator of mud performance or degradation;
- seepage loss trends, including additional seepage or fluid loss due to surge while run in hole ("RIH") or gain through swab while pulling out of hole ("POOH");
- annular velocity profile that accounts for the well construction configuration based on well geometries and influenced by, pump rate, bit depth, and coiled tubing ("CT") or drill string speed while moving the drill string in or out of the hole;
- sweep position as the sweep is pumped down the CT or drill string and circulated up the annulus; and
- sweep vertical column as the sweep is pumped down the CT and circulated up the annulus.

A method to monitor drilling performance of a drilling system—such as, but not limited to an oil well, gas well, injection well, or geothermal well—includes using a microprocessor in network communication with an inlet and outlet side mass flow meter of a coiled tubing or drill string, the method using the meters and the microprocessor to:

- collect fluid mass flow and density data on a fluid input and fluid output side of a well being drilled;
- adjust the density data for temperature and pressure; and
- using the mass flow adjusted density data along with a control volume to calculate and compare a volume of fluid entering and a volume of fluid exiting the well after accounting for circulation time within the well.

The method may also include determining the depth of the bit when fluid exiting the well exited the bit (lag time) while circulating bottoms-up and movement of the drill string. The method may also include displaying the circulating annular velocities in the well and displaying the position of sweeps in the well. Last, the method may display at least one circulating or drilling performance parameter such as, but not limited to lagged bit depth compared to outflow, a calculated cuttings recovery volume, a carrying capacity of drilling mud, seepage loss, an annular velocity profile, a sweep position, and a sweep vertical column.

Embodiments of the system and method may also be used for over-balanced managed pressure drilling ("MPD"). Managed pressure drilling is a technique that tries to control the annular pressure throughout a wellbore by making adjustments that keep this pressure above the formation fluid pressure—to prevent formation fluids from entering the wellbore—but below the pressure at which the formation can begin to fracture. The decision to make an adjustment is typically based on a spreadsheet, called a trip schedule (known in the art), that assumes an average mud density at well depths and makes use of various drilling formulas known in the art.

Figure 25:
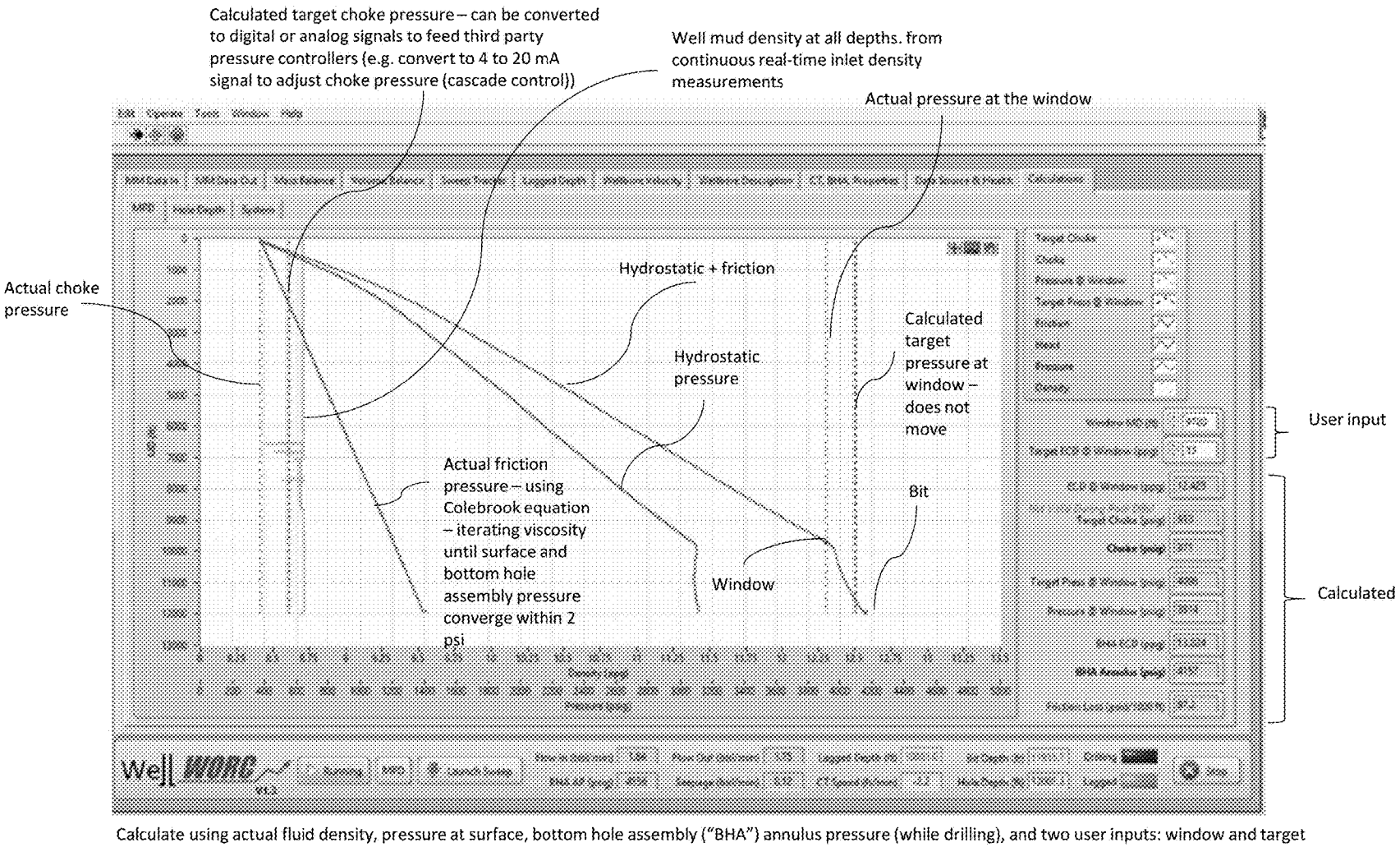

Referring now to FIG. 25, embodiments of this disclosure interface with known means to measure pressure at the surface and the bottom hole assembly ("BHA") annulus pressure. A computer having a microprocessor and software (non-transitory computer readable medium) executes real time analytical processing of the meter flow data, density and pressure data, and displays analytical trends. Two user inputs—a managed depth window (in feet) and a target equivalent circulating density ("ECD") at the window—can be used, in combination with actual fluid density, pressure at the surface, and bottom hole assembly ("BHA") annulus pressure, to calculate at all depths, or selected sampled depths, a mud density hydrostatic pressure, a target choke pressure, a friction pressure, a target hydrostatic and friction pressure, and a total pressure (hydrostatic+friction). Window, as used here, can be an actual window exit from the casing or any depth in a well.

In embodiments, the system and method may include a set of computer executable instructions including an equation to calculate a friction factor and friction pressure (such as, but not limited to, a Colebrook equation). The equation may be used to iterate viscosity until the measured choke and bottom hole assembly pressures converge within a predetermined range. The predetermined range may be within 5 psi. Or, the predetermined range may be within 2 psi, or any other predetermined range suitable for the intended purpose.

The set of computer executable instructions may include as inputs a user-defined managed depth window and a target equivalent circulating density at the managed depth window. A display may present the well mud density, the calculated target choke pressure and the measured choke pressure, the measured bottom hole annulus pressure, the friction pressure, the combined choke, hydrostatic and friction pressure, and the target combined choke, hydrostatic and friction pressure. The calculated target choke pressure may be displayed to an operator who then uses an interface such as a touch screen to change the set point pressure of the choke. Or, a signal may be sent to a choke control software system, using interface protocols known in the art, to automatically change a set point pressure of the choke.

Figure 26:
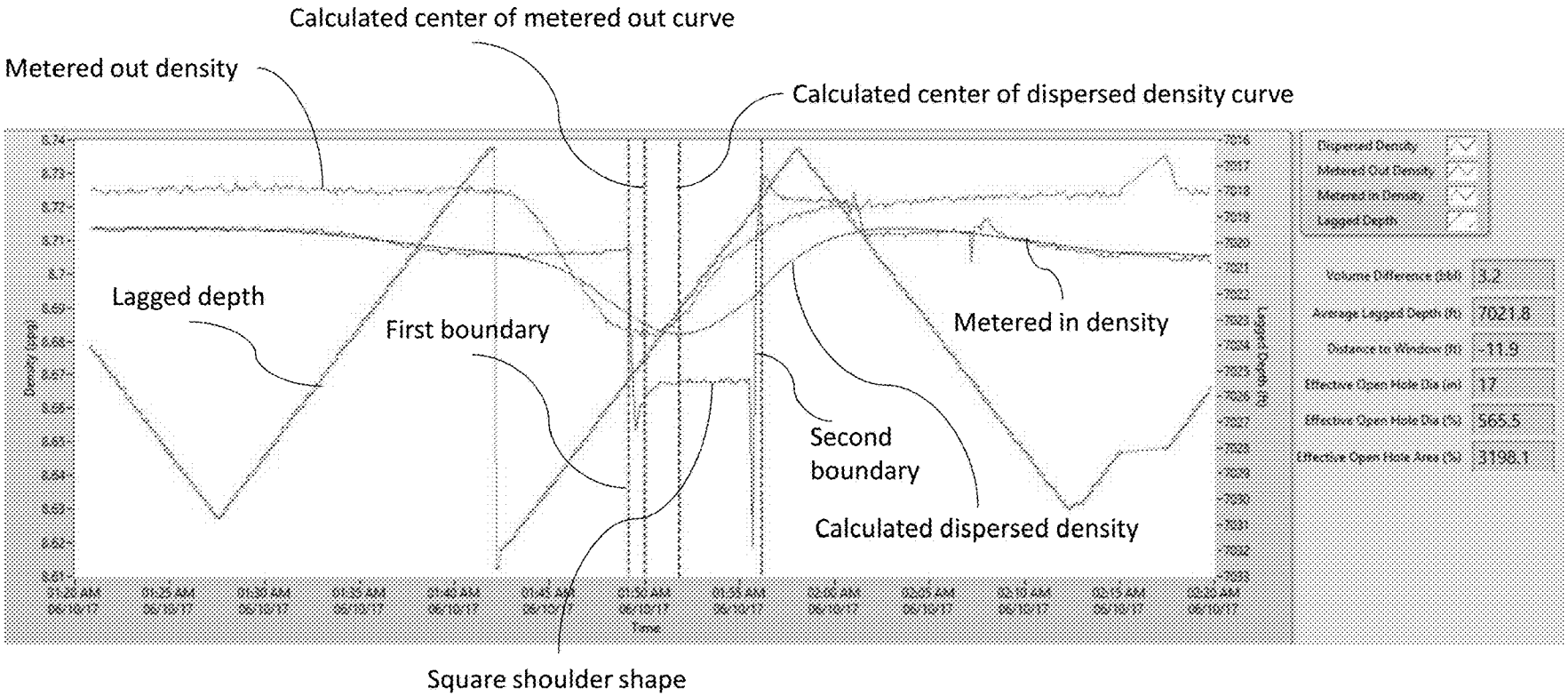
Figure 27:
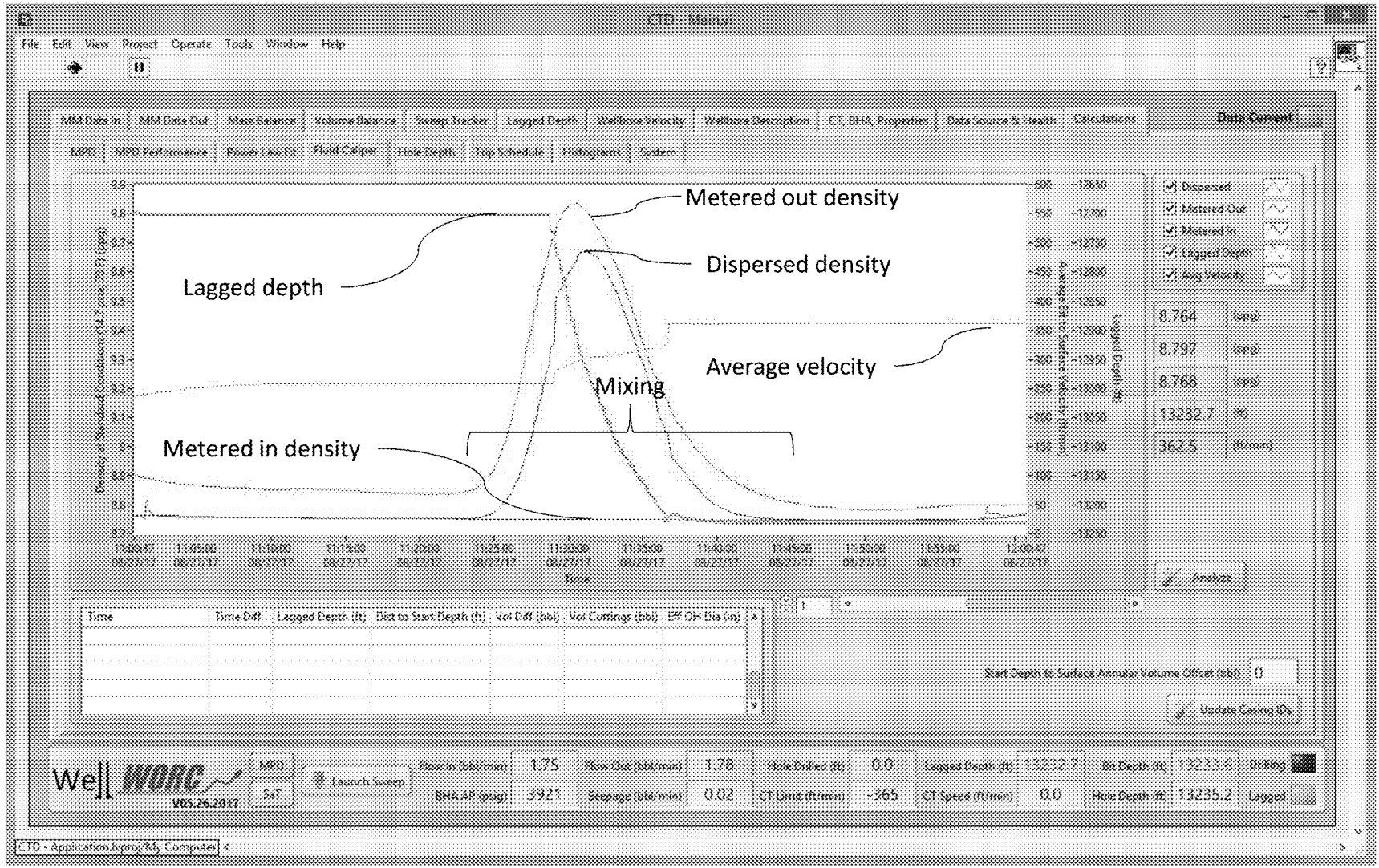

Referring to FIGS. 26 & 27, the system and method may be used as a fluid tracking engine. In some embodiments, a fluid caliper is used. Fluid calipers are used to survey the well to determine string volumes or borehole volumes; an example is determining the volume of cement needed to circulate the cement or bring the cement up to desired height. These calipers typically differ in density from the drilling mud or fluid, include a dye, and are circulated as a fluid packet. The packet when circulating can become "smeared" because of diffusion and dispersion. This makes it difficult to know where the center of the fluid caliper is because of early or late arrival of the caliper fluid. And if the open hole volume is not the gauge hole volume, the fluid packet arrival time may not align with the expected arrival time. Prior art practice, therefore, is to add about 15% to 20% to the calculated cement volume to account for over gauge hole as well as losses from pumping cement.

In embodiments of a fluid tracking engine of this disclosure, a software system more accurately tracks fluid in a wellbore circulation system. The circulation system can be as rudimentary as only a pump stroke counter measuring the inlet fluid rate, or as sophisticated as inlet and outlet Coriolis meters measuring mass flow and density. Fluids can be tracked using inlet flow only, or using inlet and outlet flow. Accuracy of the fluid tracking provided by the embodiments improves with the level of measurement sophistication. The fluid tracking engine accounts for fluid displacement from pipe movement and, depending on the sophistication of the measurement system, accounts for fluid loss and gain in the wellbore.

The fluid tracking engine may also track a fluid caliper along with measurements of density-in and density-out. The system and method track and display the metered-in and metered-out density as well as a dispersion density. The dispersion density may be calculated using a mathematical methods and equations of diffusion (such as, but not limited, to Fick's equation). This approach allows the "smeared" outlet fluid packet to be "aligned" with the inlet fluid packet. For example, where there is no diffusion or dispersion, the metered-out density curve tracks along with the metered-in density curve, offset only by the volume of the circulation. Where metered-in density and metered-out density lay on top of one another, the volume of the hole was correctly estimated. Any offset in the alignment is a consequence of hole volume or the velocity flow behavior of the caliper fluid. Multiple fluid calipers over differing wellbore sections may be necessary to account for velocity flow behavior of the caliper fluid. This permits a user to "caliper" the hole, with the output being the hole volume.

The system and method may also "align" the center of the fluid packet, a leading edge, or a trailing edge to improve fluid caliper accuracy. Vertical lines may be placed on a center or calculate center of the metered-in, metered-out, and calculated dispersion curves. Vertical lines may also be used on the leading and trailing edges of the packet, for example, where metered-in density suddenly drops and then rises, typically indicated by a "square shoulder" shape). Because of more accurate tracking of the fluid caliper, accuracy of the calculated cement volume to be pumped improves. The embodiments may also provide an independent cross-check of cuttings recovery.

Referring now to FIG. 27, embodiments of the system and method may be used to track fluid density in the well for every foot (or other predetermined distance unit). Each subsequent time the bit is run in the hole and encounters the old density, it gets mixed with the new density. This mixed density may be used to compare the "Metered Out" density and calculate cuttings recovery. By way of a non-limiting example, "Metered In" density as shown in FIG. 27 is constant for the plot. However, the "Dispersed" density accounts for mixing and shows a large response to mixing, with a peak at about 11:30 on the plot. There is high correlation with "Metered Out" at the same peak.

Figure 28:
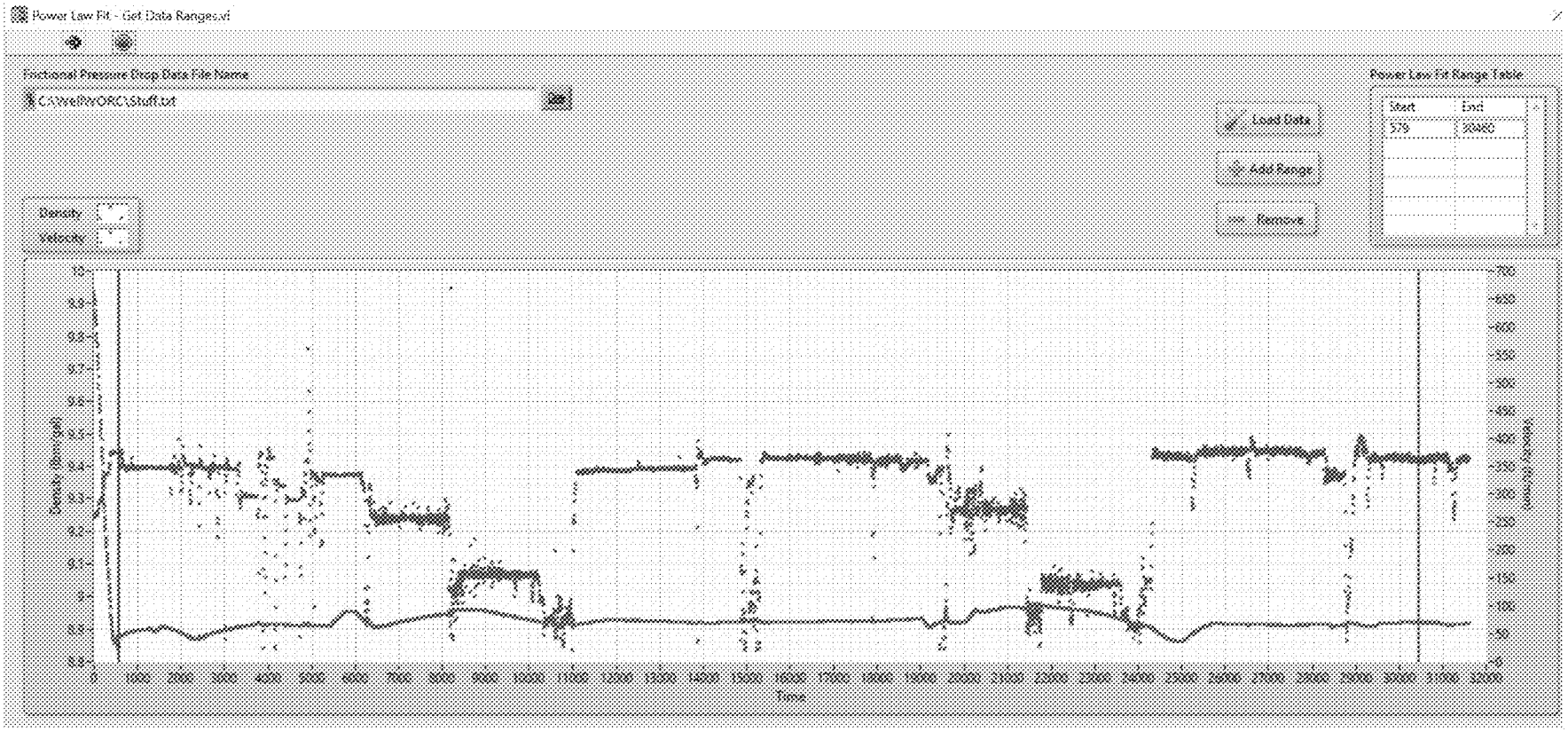
FIG. 28 is an screenshot illustrating the use of the wellbore circulation system as a viscometer.
Figure 29:
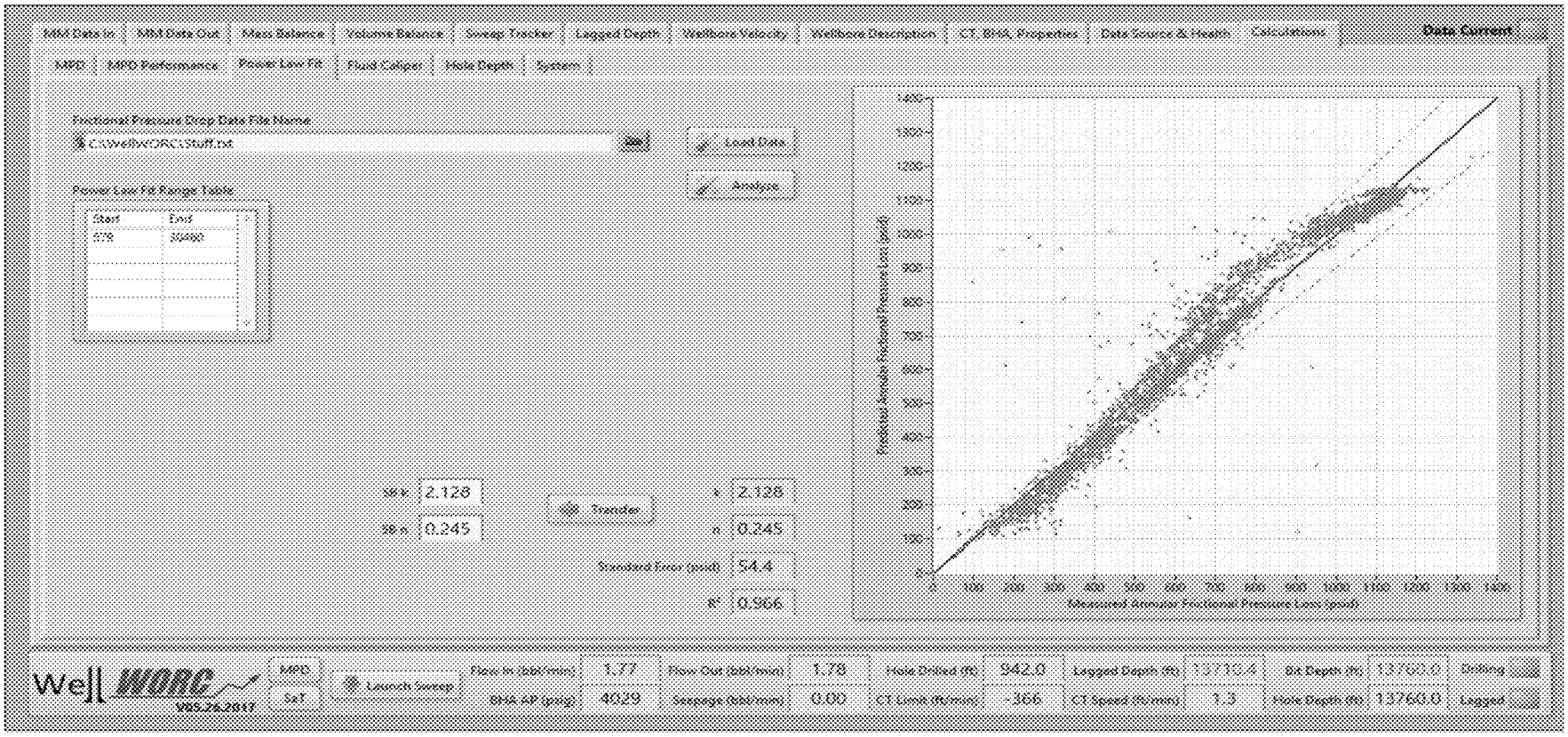
FIG. 29 is another screenshot illustrating the use of the wellbore as a viscometer and showing predicted annular frictional pressure loss using the flow consistency and flow behavior indexes and measured annular friction pressure loss.

Referring now to FIGS. 28 and 29, in embodiments the wellbore circulation system may be used as a viscometer.

By using the wellbore as a viscometer, the relationship between viscosity and velocity of the fluid is established thereby allowing for calculation of the circulating friction pressure in the wellbore annulus. This friction pressure then provides the ability to calculate the circulating bottom hole pressure with a single boundary (surface pressure), flow rate, and density.

Using the wellbore as a viscometer also accounts for the temperature effects on viscosity. Fluid viscosity changes with temperature and, normally, the viscosity is reduced with increasing temperature. Because wellbores have temperature gradients, and temperatures are normally much higher down hole than at surface, using the wellbore as a viscometer accounts for the temperature gradient without the need for viscosity temperature relationships like those required in laboratory settings. The fluid rheological properties such as viscosities, flow behavior, and flow consistency are commonly measured with laboratory instruments at room temperature. For these approaches to be accurate, a viscosity temperature relationship is necessary. In theory, it might be possible to apply this relationship to a field setting. However, doing so is highly impractical for the field, and in the case of water-based fluids above the boiling point for water, even impractical in a suitable laboratory.

For example, using techniques and equations known in the art and applied to Power Law fluids, the flow consistency index "K" and the flow behavior index "n" can be solved for. These indexes K and n provide the necessary viscosity relationship to velocity in order to calculate frictional pressure loss. With frictional pressure loss being known, the bottom hole pressure can be calculated with a single boundary (e.g. surface pressure only). In a same or similar manner, Newtonian and Bingham plastic viscosities can be solved for, and those viscosities may be used to calculate the friction pressure.

Whether Newtonian, Bingham Plastic, or Power Law equations are applied depends on the type of fluid contained in the drilling muds. For example:

1. Newtonian—a fluid that has a single viscosity that does not change with the fluid shear rate (clean water is a Newtonian fluid);

2. Bingham Plastic—a fluid that has a single viscosity that does not change with the fluid shear rate, however it also has gel strength and a minimum yield stress (it takes some pressure to overcome the yield strength before it will flow like a fluid, up to the yield point it has plastic behavior); and 3. Power Law—a fluid that is viscoelastic, meaning the viscosity changes with fluid shear rate. There are multiple forms of Power Law fluid equations (with and without minimum yield stress). All Power Law equations use the flow behavior and consistency indexes that are calculated when using the wellbore as a viscometer.

In embodiments of the viscometer, the method includes transmitting fluid mass flow and density data collected by the inlet and outlet side flow measurements and surface pressure and downhole pressure to a microprocessor for use in the required calculations. Mass flow and fluid density data and pressure data are used to calculate, depending on the type of fluid, a flow consistency index and a flow behavior index, a Newtonian viscosity, and a Bingham Plastic viscosity. The calculated flow consistency and flow behavior indexes may be used to calculate a friction pressure using Power Law fluid equations. The calculated Newtonian viscosity may be used to calculate a friction pressure using Newtonian fluid equations. The calculated Bingham Plastic viscosity may be used to calculate a friction pressure using Bingham Plastic equations. The results may be displayed graphically in real time as fluid circulating in the well continues.

Examples of the system and method of this disclosure include the following embodiments.

Example 1

A system for monitoring a drilling or circulating system of a well, the system including inlet-side flow measurements on a suction or discharge side of a pump to the well; outlet-side flow measurements from the well; means to make calculations with mass flow and density data from the inlet-side flow and outlet-side flow measurements; a set of computer executable instructions stored on non-transitory computer readable medium and executed by a microprocessor, the microprocessor being in electronic communication with the inlet- and outlet side flow measurements to receive mass flow and density data; the set of computer executable instructions using a control volume and the mass flow and density data from said flow measurements to calculate in real time a mass balance of the drilling or circulating system, the density data being adjusted for temperature and pressure. The control volume may be a wetted wellbore volume V accounting for the mass balance, $\dot{m}_{in}=\dot{m}_{out}+\dot{m}_{accumulated}$. A display in electronic or network communication with the microprocessor or associated software may be used to display at least one circulating or drilling performance parameter: lagged bit depth compared to outflow, a calculated cuttings recovery volume, a carrying capacity of drilling mud, seepage loss, an annular velocity profile, a sweep position, and a sweep vertical column.

Example 2

A method to monitor performance of a drilling or circulating system of a well, the method executed by a microprocessor and associated software in electronic communication with at least one meter data transmitter in electronic communication with an inlet side and an outlet side mass flow meter, the method including transmitting fluid mass flow and density data collected by the inlet and outlet side mass flow meters to the microprocessor and the microprocessor: adjusting the fluid density data for temperature and pressure, comparing a volume of fluid entering and a volume of fluid exiting the well after accounting for circulation time within the well, and calculating a mass flow balance, $\dot{m}_{in}=\dot{m}_{out}+\dot{m}_{accumulated}$;

where:

$$\dot{m}_{in}=\dot{m}_{in(surface)}+\dot{m}_{in(bit)}+\dot{m}_{in(open\ hole)};\text{ and}$$

$$\dot{m}_{out}=\dot{m}_{out(surface)}+\dot{m}_{out(open\ hole)}.$$

The control volume may be wetted wellbore volume V accounting for the mass flow balance. $\dot{m}_{in}$(bit) may be a function of bit diameter, bit depth, cutting force, rock density, and time. A display in electronic or network communication with the microprocessor or associated software may be used to display at least one circulating or drilling performance parameter: lagged bit depth compared to outflow, a calculated cuttings recovery volume, a carrying capacity of drilling mud, seepage loss, an annular velocity profile, a sweep position, and a sweep vertical column.

Example 3

A system for monitoring a drilling or circulating system, the system including an inlet-side flow measurements located on a suction or discharge side of a pump to the well system; an outlet-side flow measurements from a well system; a set of computer executable instructions stored on non-transitory computer readable medium and executed by a microprocessor in electronic communication with the inlet- and outlet-side flow measurements. The set of computer executable instructions adjusting flow measurements density data for temperature and pressure, and using as inputs the adjusted flow measurements density data, along with at least a measured choke pressure, to calculate at all or selected depths: a mud density hydrostatic pressure, a target choke pressure, a friction pressure, a combined hydrostatic and friction pressure, and a target combined choke, hydrostatic and friction pressure. The set of computer executable instructions may include equations to calculate a friction factor and friction pressure. The equations may iterate viscosity until the measured choke and bottom hole assembly pressures converge within a predetermined range. One of the inputs being used by the set of computer executable instructions may be a measured bottom hole annulus. Another of the inputs may be the outlet-side flow measurements. The inputs may also include a user-defined managed depth window and a target equivalent circulating density at the managed depth window. A display in electronic or network communication with the microprocessor or associated software may be used to display the well mud density, the calculated target choke pressure and the measured choke pressure. The display may also present the measured bottom hole annulus pressure, the friction pressure, the combined choke, hydrostatic and friction pressure, and the target combined choke, hydrostatic and friction pressure.

Example 4

A system for monitoring a fluid circulating in a well, the system including an inlet-side flow measurements on a suction or discharge side of a pump to the well; an outlet-side flow measurements from the well; a set of computer executable instructions stored on non-transitory computer readable medium and executed by a microprocessor in electronic communication inlet-side and outlet-side flow measurements; the set of computer executable instructions using a control volume and flow measurements mass flow and density data to display a metered-in and meter-out density after accounting for circulation time within the well. The fluid may include a fluid caliper and the set of computer executable instructions may calculate a dispersed density of the fluid caliper and compare the dispersed density over time to at least one of the metered-in and metered-out densities.

Example 5

A method to monitor a fluid circulating in a well, the method executed by a microprocessor and associated software in electronic communication with at least one data transmitter in electronic communication with an inlet side and an outlet side flow measurements, the method including transmitting fluid mass flow and density data collected by the inlet and outlet side flow measurements to the microprocessor, the microprocessor adjusting the fluid density data for temperature and pressure, comparing a volume of fluid entering and a volume of fluid exiting the well after accounting for circulation time within the well, and displaying a metered-in and a metered-out density of the fluid on a display. The fluid may include a fluid caliper. The method may calculate in real time a dispersed density of the fluid caliper, align the fluid caliper with the metered-in density; and display the dispersed density. The method may also compare the dispersed density to at least one of the metered-in and metered-out densities. The dispersed density may be calculated using at least one equation of dispersion. The display may display a vertical line at a center of a metered-in, metered-out, and dispersion density curve, or the method may display a vertical line at a leading edge, a trailing edge, or both a leading and trailing edge of the dispersed density. The method may calculate a hole volume by comparing the metered-in density and the metered-out density.

Example 6

A method to monitor a fluid circulating in a well, the method executed by a microprocessor and associated software in electronic communication with at least one data transmitter in electronic communication with an inlet side and an outlet side flow measurements, a surface pressure and a downhole pressure, the method including transmitting fluid mass flow and density data collected by the inlet and outlet side flow measurements and surface pressure and downhole pressure to the microprocessor; the microprocessor using the mass flow and fluid density data and pressure data to calculate at least one of a flow consistency index and a flow behavior index, a Newtonian viscosity, and a Bingham Plastic viscosity, and, for a Power Law fluid, using the calculated flow consistency and flow behavior indexes to calculate a friction pressure using Power Law fluid equations; for a Newtonian fluid, using the calculated Newtonian viscosity to calculate a friction pressure using Newtonian fluid equations; and for a Bingham Plastic fluid, using the calculated Bingham Plastic viscosity to calculate a friction pressure using Bingham Plastic equations.

The embodiments have been described with reference to particular means, materials and embodiments. This description is not intended to limit the disclosure to these particulars. Rather, it extends to all functionally equivalent structures, methods, and uses, such as are within the scope of the following claims.

What is claimed:

1. A method to monitor performance of a drilling or circulating system of a well, the method comprising:

inputting fluid mass flow and fluid density data continually collected by an inlet and outlet side flow measurements to at least one microprocessor including associated software;

inputting to the at least one microprocessor a measured surface pressure, a measured downhole pressure, a user-defined managed depth window, and a target equivalent circulating density at the user-defined managed depth window;

the at least one microprocessor:

adjusting the fluid density data for temperature and pressure; and calculating, using as an input at least the fluid mass flow data and the adjusted fluid density data, a mass flow balance, a wellbore pressure, or the mass flow balance and the wellbore pressure.

2. A method according to claim 1, further comprising:

the at least one microprocessor, using the fluid mass flow data, the adjusted fluid density data, and the measured surface and downhole pressures to calculate at least one of a flow consistency index and a flow behavior index, a Newtonian viscosity, and a Bingham Plastic viscosity; and for a Power Law fluid, using the calculated flow consistency and flow behavior indexes to calculate a friction pressure using Power Law fluid equations;

for a Newtonian fluid, using the calculated Newtonian viscosity to calculate a friction pressure using Newtonian fluid equations; and for a Bingham Plastic fluid, using the calculated Bingham Plastic viscosity to calculate a friction pressure using Bingham Plastic equations.

3. A method according to claim 1, wherein the calculated mass flow balance is $$\dot{m}_{in}=\dot{m}_{out}+\dot{m}_{accumulated};$$

and wherein $$\dot{m}_{in}=\dot{m}_{in(surface)}+\dot{m}_{in(bit)}+\dot{m}_{in(open\ hole)};\text{ and}$$

$$\dot{m}_{out}=\dot{m}_{out(surface)}+\dot{m}_{out(open\ hole)}.$$

4. A method according to claim 1, wherein the input further includes a control volume.

5. A method according to claim 4, wherein the control volume is a wetted wellbore volume.

6. A method according to claim 1, wherein the measured surface pressure is a choke pressure.

7. A method according to claim 1, wherein the measured downhole pressure is a bottom hole assembly annulus pressure.

8. A method according to claim 1, further comprising:

the at least one microprocessor iterating a viscosity value until the measured surface pressure and the measured downhole pressure converge within a predetermined range.

9. A method according to claim 1, wherein the measured surface pressure is a choke pressure and the calculated wellbore pressure is a target choke pressure, the method further comprising:

comparing the choke pressure to the target pressure; and adjusting the choke pressure based upon the calculated target choke pressure.

10. A method according to claim 1, wherein the calculated wellbore pressure is at least one pressure selected from the group consisting of a mud density hydrostatic pressure, a target choke pressure, a friction pressure, a target hydrostatic and friction pressure, and a total hydrostatic and friction pressure.

11. A method according to claim 1, the method comprising:

wherein the drilling or circulating system includes a fluid caliper;

the at least one microprocessor calculating a dispersed density of the fluid caliper, and displaying the calculated dispersed density.

12. A method according to claim 11, wherein the calculated dispersed density is calculated using at least one equation of dispersion.

13. A method according to claim 11, further comprising:

the at least one microprocessor aligning the fluid caliper with the adjusted fluid density data.

14. A method according to claim 11, further comprising:

comparing the calculated dispersed density to the adjusted fluid density data.

15. A method according to claim 11, wherein the displayed calculated dispersed density includes a curve, the method further comprising:

displaying a vertical line at a center of the curve.

16. A method according to claim 15, further comprising:

displaying a vertical line at a leading edge, a trailing edge, or both a leading and trailing edge of the curve.

17. A method according to claim 1, further comprising:

the at least one microprocessor, using the fluid mass flow data, the adjusted fluid density data, and the measured surface and downhole pressures to calculate at least one of a flow consistency index and a flow behavior index, a Newtonian viscosity, and a Bingham Plastic viscosity; and for a Power Law fluid, using the calculated flow consistency and flow behavior indexes to calculate a friction pressure using Power Law fluid equations;

for a Newtonian fluid, using the calculated Newtonian viscosity to calculate a friction pressure using Newtonian fluid equations; and for a Bingham Plastic fluid, using the calculated Bingham Plastic viscosity to calculate a friction pressure using Bingham Plastic equations.

18. A method according to claim 1, wherein at least one of the inlet and outlet side flow measurements includes a mass flow meter.

19. A method according to claim 1, further comprising:

the at least one microprocessor calculating a hole volume by comparing the adjusted fluid density of the inlet and outlet side flow measurements.

20. A method to monitor performance of a drilling or circulating system of a well, the method comprising:

inputting fluid mass flow and fluid density data continually collected by an inlet and outlet side flow measurements to at least one microprocessor including associated software;

the at least one microprocessor:

adjusting the fluid density data for temperature and pressure; and calculating, using as an input at least the fluid mass flow data and the adjusted fluid density data, a mass flow balance, a wellbore pressure, or the mass flow balance and the wellbore pressure;

wherein the drilling or circulating system includes a fluid caliper;

the at least one microprocessor calculating a dispersed density of the fluid caliper, and displaying the calculated dispersed density.

21. A method according to claim 20, further comprising:

inputting to the at least one microprocessor a measured surface pressure, a measured downhole pressure, a user-defined managed depth window, and a target equivalent circulating density at the user-defined managed depth window.

22. A method according to claim 20, wherein the calculated mass flow balance is $$\dot{m}_{in}=\dot{m}_{out}+\dot{m}_{accumulated};$$

and wherein $$\dot{m}_{in}=\dot{m}_{in(surface)}+\dot{m}_{in(bit)}+\dot{m}_{in(open\ hole)};\text{ and}$$

$$\dot{m}_{out}=\dot{m}_{out(surface)}+\dot{m}_{out(open\ hole)}.$$

23. A method according to claim 20, wherein the input further includes a control volume.

24. A method according to claim 23, wherein the control volume is a wetted wellbore volume.

25. A method according to claim 20, wherein the measured surface pressure is a choke pressure.

26. A method according to claim 20, wherein the measured downhole pressure is a bottom hole assembly annulus pressure.

27. A method according to claim 20, further comprising:

the at least one microprocessor iterating a viscosity value until the measured surface pressure and the measured downhole pressure converge within a predetermined range.

28. A method according to claim 21, wherein the measured surface pressure is a choke pressure and the calculated wellbore pressure is a target choke pressure, the method further comprising:

comparing the choke pressure to the target pressure; and adjusting the choke pressure based upon the calculated target choke pressure.

29. A method according to claim 20, wherein the calculated wellbore pressure is at least one pressure selected from the group consisting of a mud density hydrostatic pressure, a target choke pressure, a friction pressure, a target hydrostatic and friction pressure, and a total hydrostatic and friction pressure.

30. A method according to claim 20, wherein the calculated dispersed density is calculated using at least one equation of dispersion.

31. A method according to claim 20, further comprising:

the at least one microprocessor aligning the fluid caliper with the adjusted fluid density data.

32. A method according to claim 20, further comprising:

comparing the calculated dispersed density to the adjusted fluid density data.

33. A method according to claim 20, wherein the displayed calculated dispersed density includes a curve, the method further comprising:

displaying a vertical line at a center of the curve.

34. A method according to claim 33, further comprising:

displaying a vertical line at a leading edge, a trailing edge, or both a leading and trailing edge of the curve.

35. A method according to claim 20, wherein at least one of the inlet and outlet side flow measurements includes a mass flow meter.

36. A method according to claim 20, further comprising:

the at least one microprocessor calculating a hole volume by comparing the adjusted fluid density of the inlet and outlet side flow measurements.

37. A method to monitor performance of a drilling or circulating system of a well, the method comprising:

inputting fluid mass flow and fluid density data continually collected by an inlet and outlet side flow measurements to at least one microprocessor including associated software;

the at least one microprocessor:

adjusting the fluid density data for temperature and pressure; and calculating, using as an input at least the fluid mass flow data and the adjusted fluid density data, a mass flow balance, a wellbore pressure, or the mass flow balance and the wellbore pressure the at least one microprocessor, using the fluid mass flow data, the adjusted fluid density data, and a measured surface and a measured downhole pressure to calculate at least one of a flow consistency index and a flow behavior index, a Newtonian viscosity, and a Bingham Plastic viscosity; and for a Power Law fluid, using the calculated flow consistency and flow behavior indexes to calculate a friction pressure using Power Law fluid equations;

for a Newtonian fluid, using the calculated Newtonian viscosity to calculate a friction pressure using Newtonian fluid equations; and for a Bingham Plastic fluid, using the calculated Bingham Plastic viscosity to calculate a friction pressure using Bingham Plastic equations.

* * * * *